US010209666B2

(12) United States Patent
Shimizu et al.

(10) Patent No.: US 10,209,666 B2
(45) Date of Patent: Feb. 19, 2019

(54) DEVELOPING CARTRIDGE HAVING PROTRUSION PROVIDED AT DETECTION GEAR

(71) Applicant: BROTHER KOGYO KABUSHIKI KAISHA, Nagoya-shi, Aichi-ken (JP)

(72) Inventors: Keita Shimizu, Nagoya (JP); Takashi Shimizu, Nagoya (JP); Naoya Kamimura, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/472,064

(22) Filed: Mar. 28, 2017

(65) Prior Publication Data

US 2018/0095412 A1 Apr. 5, 2018

(30) Foreign Application Priority Data

Sep. 30, 2016 (JP) ..... 2016-193178

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 15/0889* (2013.01); *G03G 21/1896* (2013.01); *G03G 15/0863* (2013.01)

(58) Field of Classification Search
CPC ..... G03G 21/1647
USPC ..... 399/262
See application file for complete search history.

(56) References Cited

U.S. PATENT DOCUMENTS

2011/0236062 A1 9/2011 Takagi
2014/0186058 A1 7/2014 Shimizu
2015/0192880 A1 7/2015 Noda et al.
2015/0277281 A1 10/2015 Mushika et al.
2015/0277353 A1* 10/2015 Fukamachi ..... G03G 15/0865 399/12

FOREIGN PATENT DOCUMENTS

EP 2 927 754 A2 10/2015
JP 2011-203362 A 10/2011
WO 2016/107214 A1 7/2016

OTHER PUBLICATIONS

Extended European Search Report issued in corresponding European Application No. 17163726.7, dated Oct. 24, 2017.
Office Action issued in related European Patent Application No. 17163726.7, dated Dec. 6, 2018.

* cited by examiner

*Primary Examiner* — Quana M Grainger
(74) *Attorney, Agent, or Firm* — Merchant & Gould P.C.

(57) ABSTRACT

A developing cartridge includes first and second rotary members. The first rotary member is rotatable from a first position to a second position and from the second position to a third position, and includes a first gear part and a first rib. The first rib extends along an addendum circle of the first gear part. The second rotary member includes a second gear part and a second rib protruding outward in a radial direction of the second rotary member. The second rib is in contact the first rib during rotation of the first rotary member from the first position toward the second position. The second rib is separated from the first rib during rotation of the first rotary member from the second position toward the third position.

25 Claims, 14 Drawing Sheets

DEVELOPING CARTRIDGE HAVING PROTRUSION PROVIDED AT DETECTION GEAR

CROSS REFERENCE TO RELATED APPLICATION

This application claims priority from Japanese Patent Application No. 2016-193178 filed Sep. 30, 2016. The entire content of the priority application is incorporated herein by reference.

TECHNICAL FIELD

The present disclosure relates to a developing cartridge for use in an image forming apparatus.

BACKGROUND

Among image forming apparatuses provided with developing cartridges, there is known an image forming apparatus capable of determining whether a developing cartridge is attached to the apparatus or capable of identifying specifications of the developing cartridge. For example, prior art discloses a developing cartridge that includes a detection gear, and protrusions that move as the detection gear rotates. The developing cartridge is attached to an image forming apparatus that includes a sensor for detecting the protrusions in a case where the developing cartridge is attached.

SUMMARY

In a case where the image forming apparatus determines specifications of a developing cartridge by detecting protrusions, the layout pattern of the protrusions is varied for each developing cartridge with different specifications. In this way, the image forming apparatus can identify the specifications of a developing cartridge from among a plurality of different specifications. Therefore, a new gear structure is needed to support the increasing variety of specifications in developing cartridges.

In view of the foregoing, it is an object of the present disclosure to provide a developing cartridge having a new gear structure for identifying specifications of the developing cartridge.

This and other objects will be attained by providing a developing cartridge including: a casing, a first rotary member, and a second rotary member. The casing is configured to accommodate therein developing agent. The first rotary member is rotatable about a first axis extending in an axial direction from a first position to a second position and from the second position to a third position. The first rotary member is positioned at an outer surface of the casing. The first rotary member includes: a first gear part, and a first rib. The first gear part includes a plurality of gear teeth. The first rib is rotatable together with the first gear part. The first rib is positioned at a position different from a position of the first gear part in the axial direction. The first rib extends along an addendum circle of the first gear part. The second rotary member is rotatable about a second axis extending in the axial direction. The second rotary member includes: a second gear part, and a second rib. The second gear part includes a plurality of gear teeth. The second rib protrudes outward in a radial direction of the second rotary member. The second rib is positioned at a position different from the second gear part in the axial direction. In a case where the first rotary member rotates from the first position to the second position, the second rotary member does not rotate together with the first rotary member in a state where the second rib is in contact with the first rib. In a case where the first rotary member rotates from the second position to the third position, the second rotary member rotates together with the first rotary member in a state where the second rib is not in contact with the first rib.

BRIEF DESCRIPTION OF THE DRAWINGS

The particular features and advantages of the disclosure will become apparent from the following description taken in connection with the accompanying drawings, in which:

FIG. 8(*b*) is a plan view of a detection gear as viewed in an axial direction thereof in the developing cartridge according to the embodiment;

FIG. 8(*c*) is an enlarged perspective view of the detection gear;

FIG. 9(*b*) is a view illustrating the initial position of the second agitator gear and the detection gear, when viewed from an outside;

FIG. 10(*b*) is a view illustrating the second agitator gear and the detection gear, when viewed from the inside and particularly illustrating a state where second rib is out of contact from the first rib, and meshing engagement between a first gear part and a second gear part is started in the developing cartridge according to the embodiment;

FIG. 12(*b*) is a view illustrating the second agitator gear and the detection gear, when viewed from the inside, and particularly illustrating a state after the detection gear is rotated at high speed by the third gear portion in the developing cartridge according to the embodiment;

FIG. 13(*b*) is a view illustrating the second agitator gear and the detection gear, when viewed from the outside, and particularly illustrating terminal position of the detection gear and the second agitator gear in the developing cartridge according to the embodiment;

FIG. 14(*b*) is a perspective view of a detection gear according to a second modification; and FIG. 14(*c*) is a perspective view of a detection gear according to a third modification.

DETAILED DESCRIPTION

A developing cartridge according to one embodiment will be described with reference to FIGS. 1 through 13(*b*).

Figure 1:
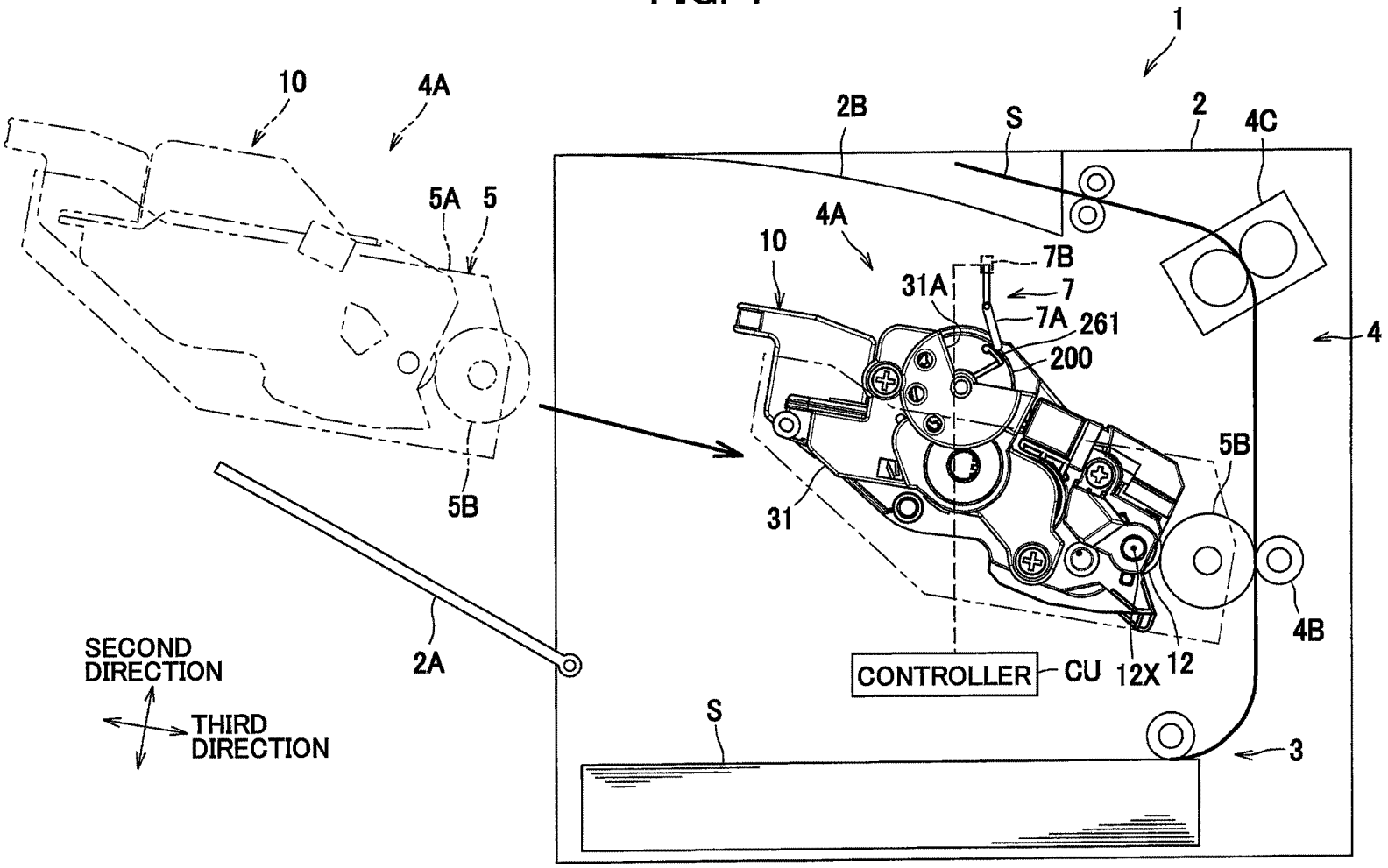
FIG. 1 is a cross-sectional view of a printer provided with a developing cartridge according to one embodiment.

FIG. 1 shows a laser printer 1 as an example of the image forming apparatus. The laser printer 1 primarily includes a housing 2, a sheet-feeding unit 3, an image-forming unit 4, and a control unit CU.

The housing 2 has a front cover 2A, and a discharge tray 2B positioned at a top of the housing 2. The sheet-feeding unit 3 and image-forming unit 4 are disposed in the housing 2. By opening the front cover 2A, a developing cartridge 10 described later can be detached from and attached to the housing 2.

The sheet-feeding unit 3 accommodates sheets S. The sheet-feeding unit 3 is configured to feed one sheet at a time to the image-forming unit 4.

The image-forming unit 4 includes a process cartridge 4A, an exposure unit (not illustrated), a transfer roller 4B, and a fixing unit 4C.

The process cartridge 4A includes a drum cartridge 5, and the developing cartridge 10. The developing cartridge 10 is detachably attached to the drum cartridge 5. After the developing cartridge 10 is attached to the drum cartridge 5, the developing cartridge 10 and drum cartridge 5 can be detachably attached together to the laser printer 1 as the process cartridge 4A. The drum cartridge 5 includes a frame 5A, and a photosensitive drum 5B rotatably supported in the frame 5A.

Figure 2:
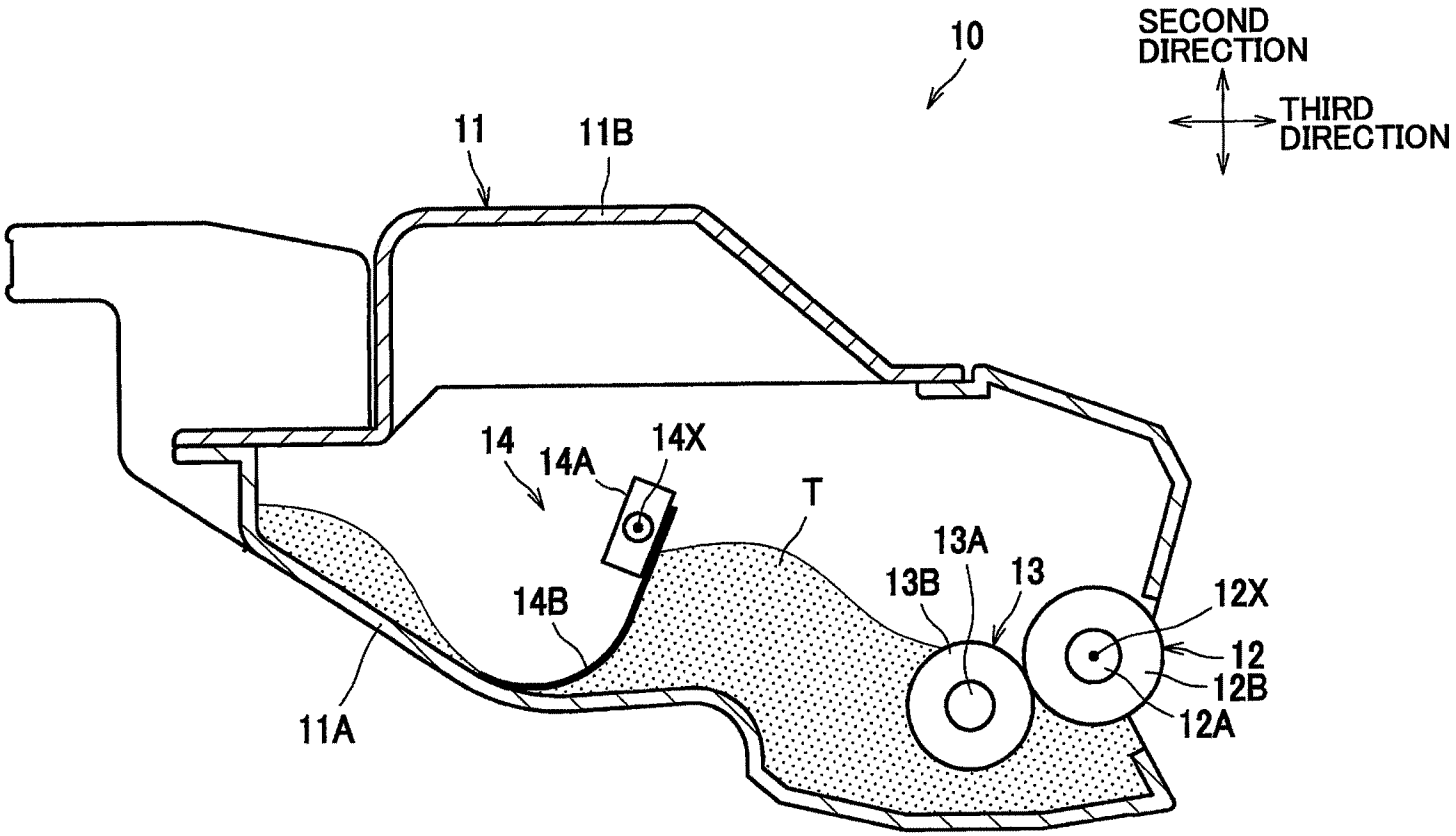
FIG. 2 is a cross-sectional view of a casing of the developing cartridge according to the embodiment.

As illustrated in FIG. 2, the developing cartridge 10 includes a casing 11, a developing roller 12, a supply roller 13, and an agitator 14.

The casing 11 includes a container 11A, a cover 11B, and an outer surface 11C. The container 11A of the casing 11 is configured to accommodate toner T. The toner T is an example of the developing agent.

The developing roller 12 includes a developing-roller shaft 12A extending in a first direction, and a roller part 12B. Here, the first direction is an axial direction of a second agitator gear 100 described later (hereinafter simply called the "axial direction"). The roller part 12B covers an outer circumferential surface of the developing-roller shaft 12A. The roller part 12B is formed of an electrically conductive rubber or the like. The developing roller 12 is rotatable about an axis of the developing-roller shaft 12A. Put another way, the developing roller 12 is rotatable about a third axis 12X extending in the first direction. The developing roller 12 is supported to the casing 11 so as to be rotatable about the third axis 12X of the developing-roller shaft 12A. Hence, the roller part 12B can rotate together with the developing-roller shaft 12A. The control unit CU is configured to apply developing bias to the developing roller 12.

The container 11A and the cover 11B of the casing 11 face each other in a second direction. The second direction crosses the first direction, and preferably is orthogonal to the first direction. The developing roller 12 is positioned at one side of the casing 11 in a third direction (hereinafter called a "first side"). The third direction crosses both the first and second directions, and is preferably orthogonal to both the first and second directions.

The supply roller 13 includes a supply-roller shaft 13A extending in the first direction, and a roller part 13B. The roller part 13B covers an outer circumferential surface of the supply-roller shaft 13A. The roller part 13B is formed of a sponge material or the like. The supply roller 13 is rotatable about an axis of the supply-roller shaft 13A. The roller part 13B can rotate together with the supply-roller shaft 13A.

The agitator 14 includes an agitator shaft 14A, and a flexible sheet 14B. The agitator shaft 14A is rotatable about a first axis 14X extending in the first direction. The agitator shaft 14A is supported to the casing 11 so as to be rotatable about the first axis 14X. The agitator 14 can rotate together with a coupling 22 described later. A base end of the flexible sheet 14B is fixed to the agitator shaft 14A, while a distal end of the flexible sheet 14B can contact an inner surface of the casing 11. The agitator 14 can agitate toner T in the casing 11 as the flexible sheet 14B rotates.

As illustrated in FIG. 1, the transfer roller 4B faces the photosensitive drum 5B. The transfer roller 4B and photosensitive drum 5B nip and convey the sheet S when the sheet S is interposed therebetween.

A charger (not illustrated) is configured to charge a surface of the photosensitive drum 5B, after which the exposure unit (not illustrated) exposes the charged surface to light to form an electrostatic latent image thereon. The developing cartridge 10 supplies toner T to the latent image to form a toner image on the photosensitive drum 5B. As the sheet S fed from the sheet-feeding unit 3 passes between the photosensitive drum 5B and transfer roller 4B, the toner image is transferred from the photosensitive drum 5B onto the sheet S.

After a toner image is transferred onto a sheet S, the sheet S passes through the fixing unit 4C, and the fixing unit 4C thermally fixes the toner image to the sheet S. The sheet S is subsequently discharged from the housing 2 into the discharge tray 2B.

The control unit CU is configured to control the overall operations of the laser printer 1.

The laser printer 1 also includes a sensor 7. The sensor 7 is configured to detect whether the developing cartridge 10 is a new product (i.e., whether the developing cartridge 10 is unused) and/or identifies specifications of the developing cartridge 10. The sensor 7 includes a lever 7A that is pivotably supported to the housing 2, and an optical sensor 7B. The lever 7A is disposed in a position for contacting protrusions that rotate together with a detection gear 200 described later. The optical sensor 7B is connected to the control unit CU and outputs detection signals to the control unit CU. The control unit CU can determine specifications and the like of the developing cartridge 10 on a basis of the signals received from the optical sensor 7B. Specifically, the optical sensor 7B detects displacement of the lever 7A and transmits the detection signals to the control unit CU on a basis of this displacement. More specifically, the optical sensor 7B employs a sensor unit that includes a light-emitting element and a light-receiving element, for example. The sensor 7 will be described later in greater detail.

Figure 3:
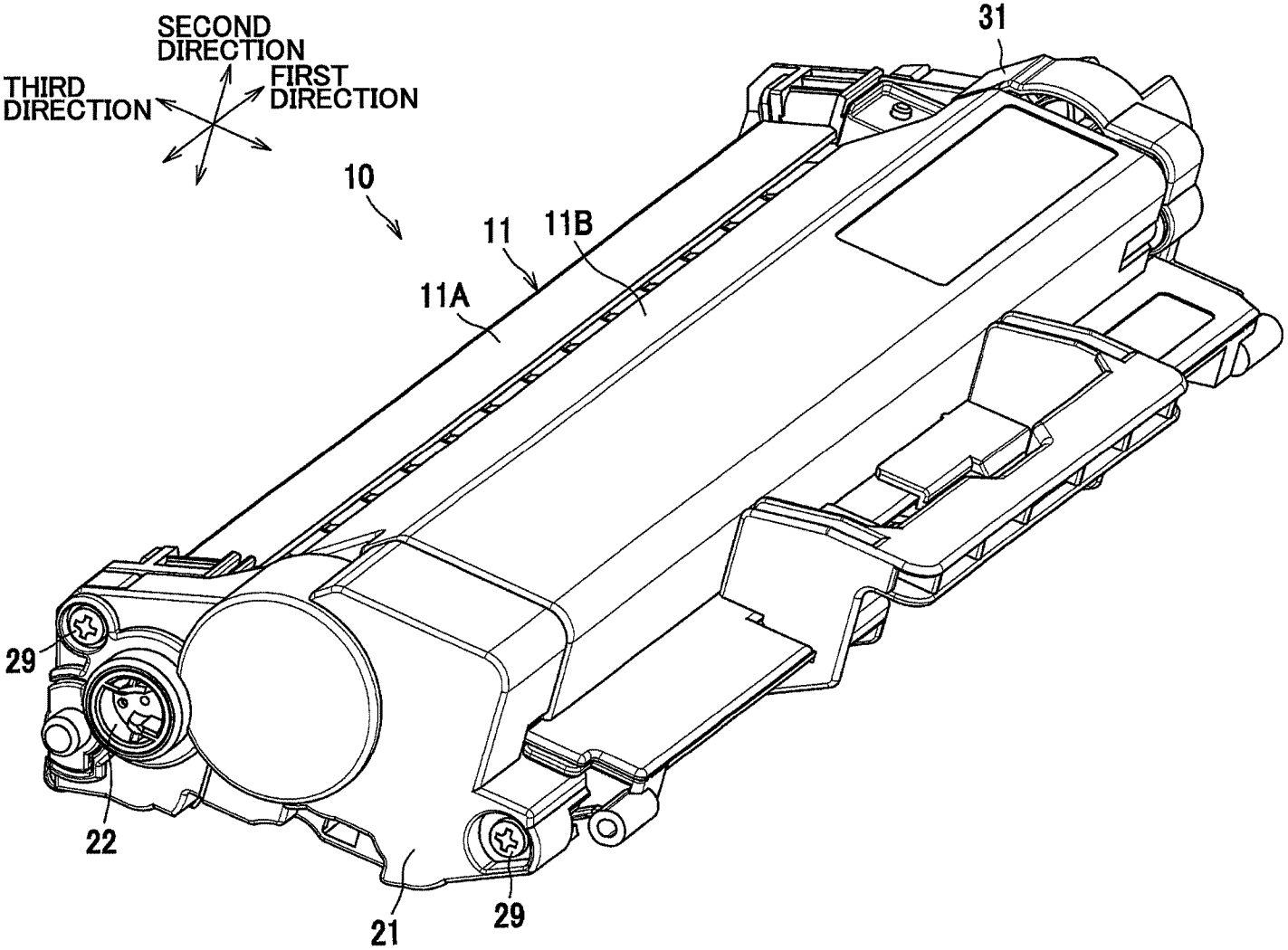
FIG. 3 is a perspective view of the developing cartridge according to the embodiment, and particularly illustrating one side portion of the cartridge as viewed in a first direction.
Figure 4:
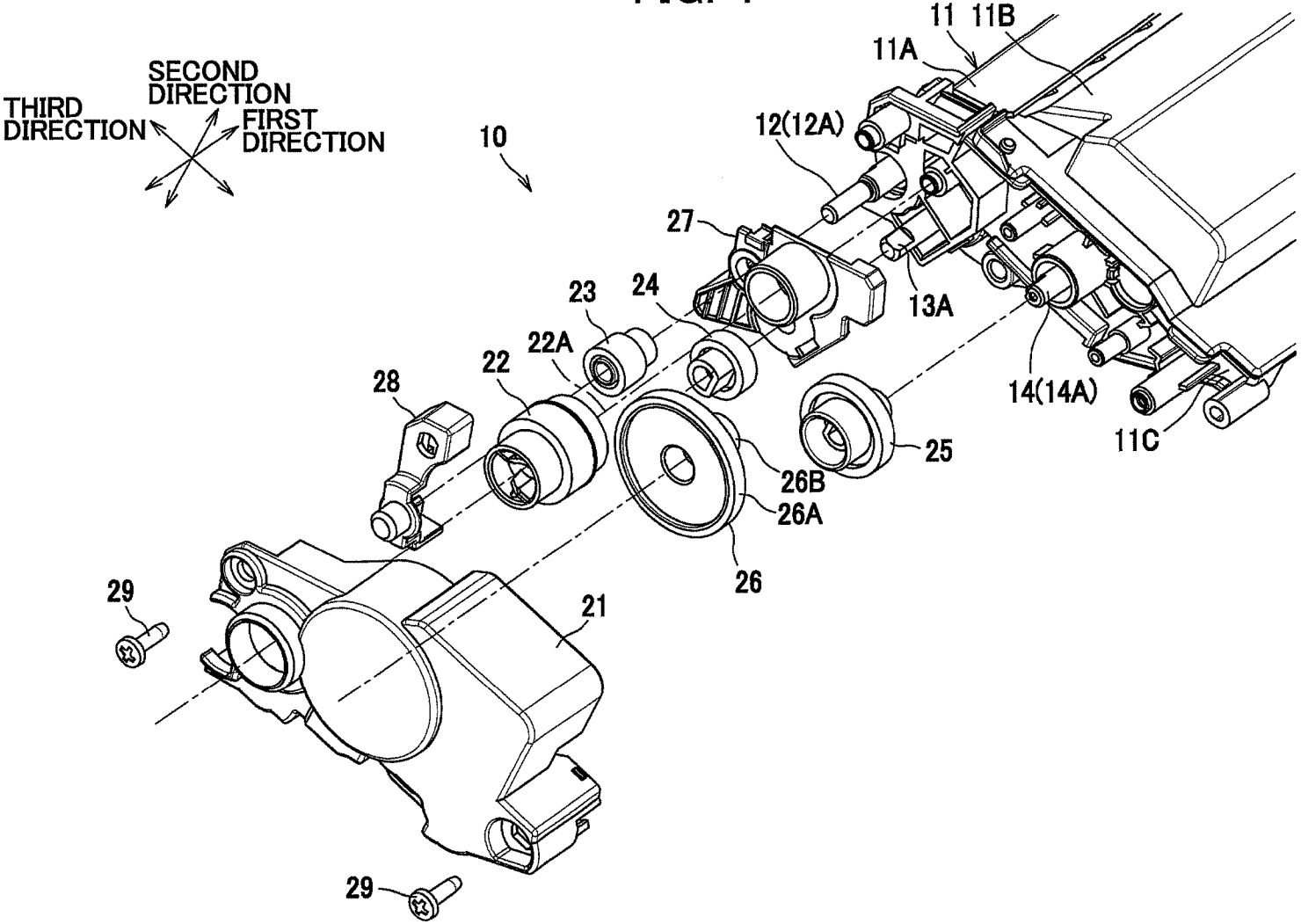
FIG. 4 is an exploded perspective view illustrating components disposed at the one side portion of the casing of the developing cartridge according to the embodiment.

Next, the structure of the developing cartridge 10 will be described in greater detail. FIGS. 3 and 4 illustrate the structure of the developing cartridge 10 at one end of the casing 11 in the first direction (hereinafter called a "first end"). At the first end of the casing 11, the developing cartridge 10 includes a first gear cover 21, the coupling 22, a developing gear 23, a supply gear 24, a first agitator gear 25, an idle gear 26, a first bearing 27, and a cap 28.

The first gear cover 21 supports the idle gear 26 via a shaft (not illustrated). The first gear cover 21 covers at least one gear positioned at the first end of the casing 11. The first gear cover 21 is fixed to the outer surface 11C of the casing 11 by screws 29. The outer surface 11C is a surface positioned at the first end of the casing 11 in the first direction.

Note that the term "gear" in the present specification is not limited to a gear member including gear teeth that transmits rotational force through the gear teeth, but may include a member that transmits rotational force through friction. In the case of members that transmit rotational force through friction, the addendum circle of the gear is defined as the circle passing along the friction-producing surface.

The coupling 22 is rotatable about an axis 22A extending in the first direction. The coupling 22 is positioned at the first end of the casing 11 relative to the first direction. That is, the coupling 22 is positioned at the outer surface 11C. The coupling 22 can rotate in response to a drive force. That is, the coupling 22 can receive a drive force from the laser printer 1. The coupling 22 can rotate by engaging with a drive member (not illustrated) provided at the laser printer 1. The coupling 22 includes a recessed part that is recessed in the first direction. The recessed part can receive and engage with the drive member. Specifically, the recessed part can engage with the drive member of the laser printer 1 to receive a drive force from the drive member.

The developing gear 23 is mounted to the developing-roller shaft 12A and can rotate together with the coupling 22. The developing gear 23 is positioned at the first end of the casing 11 in the first direction. That is, the developing gear 23 is positioned at the outer surface 11C.

The supply gear 24 is mounted to the supply-roller shaft 13A and can rotate together with the coupling 22. The supply gear 24 is positioned at the first end of the casing 11 in the first direction. That is, the supply gear 24 is positioned at the outer surface 11C.

The first agitator gear 25 is positioned at the first end of the casing 11 in the first direction. That is, the first agitator gear 25 is positioned at the outer surface 11C. The first agitator gear 25 is mounted to the agitator shaft 14A of the agitator 14. The first agitator gear 25 can rotate together with the agitator 14 in response to rotation of the coupling 22.

The idle gear 26 is positioned to face the first end of the casing 11 in the first direction. That is, the idle gear 26 is positioned to face the outer surface 11C. The idle gear 26 includes a large-diameter part 26A that engages with gear teeth on the coupling 22, and a small-diameter part 26B that engages with gear teeth on the first agitator gear 25. As described above, the idle gear 26 is rotatably supported by the shaft (not illustrated) in the first gear cover 21. The idle gear 26 transmits the rotation of the coupling 22 to the first agitator gear 25 while reducing the speed of rotation. The large-diameter part 26A is separated farther from the casing 11 than the small-diameter part 26B is from the casing 11 in the first direction.

The first bearing 27 supports the coupling 22, the developing gear 23, and the supply gear 24. The first bearing 27 is fixed to the first end of the casing 11 in the first direction.

The cap 28 covers a first end of the developing-roller shaft 12A in the first direction. Note that the first gear cover 21 and cap 28 may be formed of different types of resin.

Figure 5:
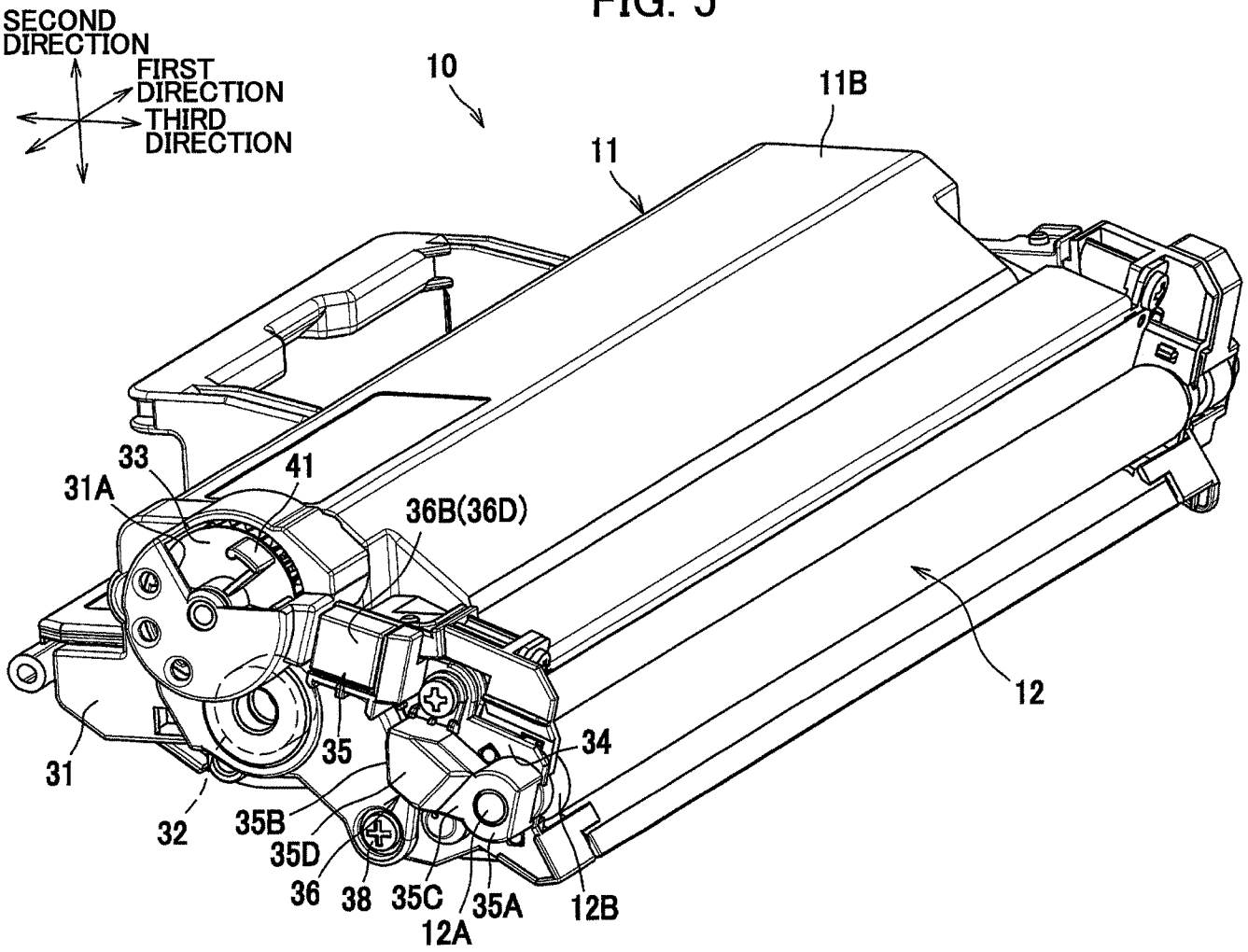
FIG. 5 is a perspective view of the developing cartridge according to the embodiment, and particularly illustrating another side portion of the cartridge as viewed in the first direction.
Figure 6:
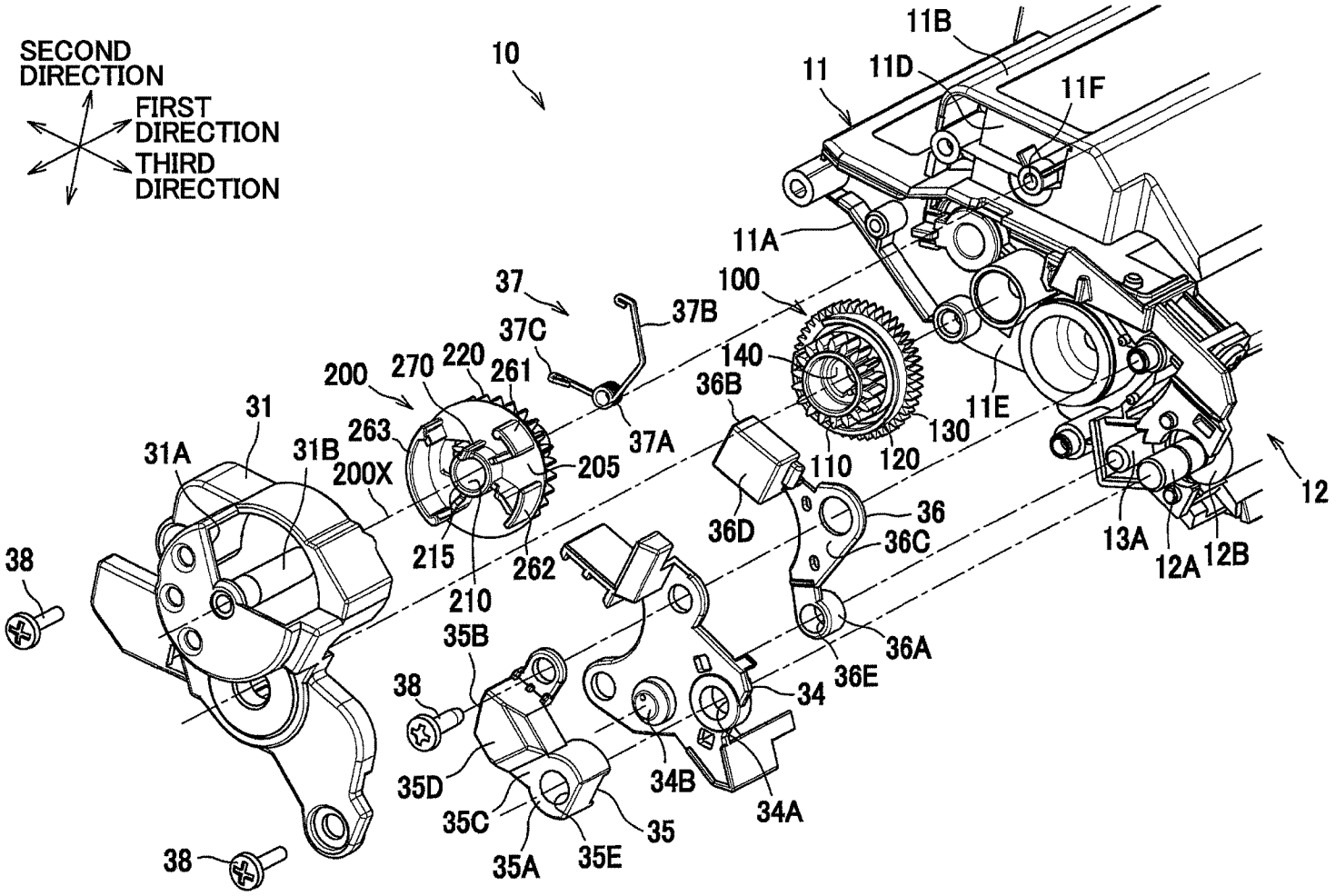
FIG. 6 is an exploded perspective view illustrating components disposed at the other side portion of the casing of the developing cartridge according to the embodiment.
Figure 7:
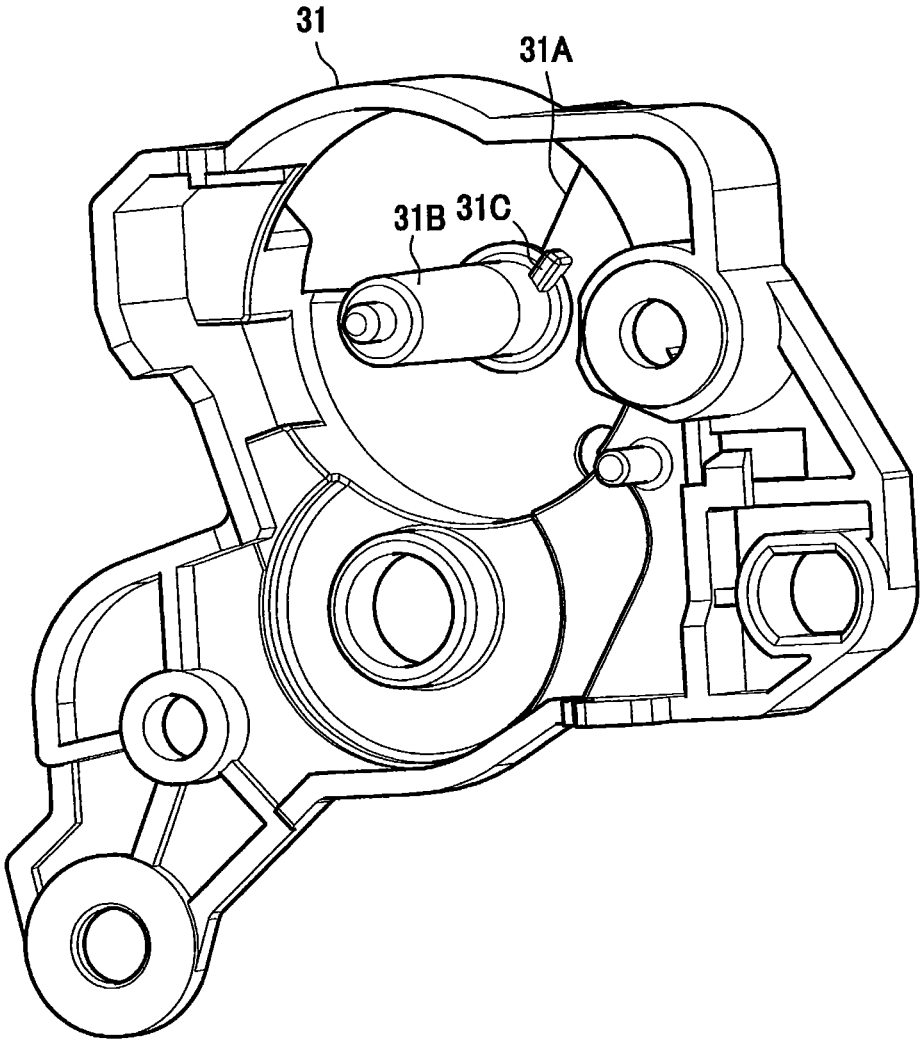
FIG. 7 is perspective view of a gear cover in the developing cartridge according to the embodiment, and illustrating an internal construction of the gear cover.

FIGS. 5 and 6 illustrate the structure of the developing cartridge 10 at the other end of the casing 11 in the first direction (hereinafter called a "second end"). At the second end, the developing cartridge 10 includes a second gear cover 31, the above-described second agitator gear 100 as an example of the first rotary member, the above-described detection gear 200 as an example of the second rotary member, a second bearing 34, a developing electrode 35, and a supply electrode 36.

The second gear cover 31 covers at least a portion of the detection gear 200. The second gear cover 31 has an opening 31A that exposes a portion of the detection gear 200 to an outside. The second gear cover 31 also includes a shaft 31B extending in the first direction. The second gear cover 31 also includes an anchoring protrusion 31C (see FIG. 7) that protrudes radially outward from the shaft 31B. The second gear cover 31 accommodates therein a torsion spring 37 as an example of the spring. The torsion spring 37 will be described later in greater detail.

The second agitator gear 100 is positioned at the second end of the casing 11 in the first direction. That is, the second agitator gear 100 is positioned at an outer surface 11E positioned at the second end of the container 11A of the casing 11. The second agitator gear 100 has a mounting hole 140. The second agitator gear 100 is mounted to the agitator shaft 14A of the agitator 14 by engaging the mounting hole 140 with the agitator shaft 14A. With this arrangement, the second agitator gear 100 can rotate together with the agitator 14. That is, the second agitator gear 100 is rotatably supported by the casing 11.

Figure 8A:
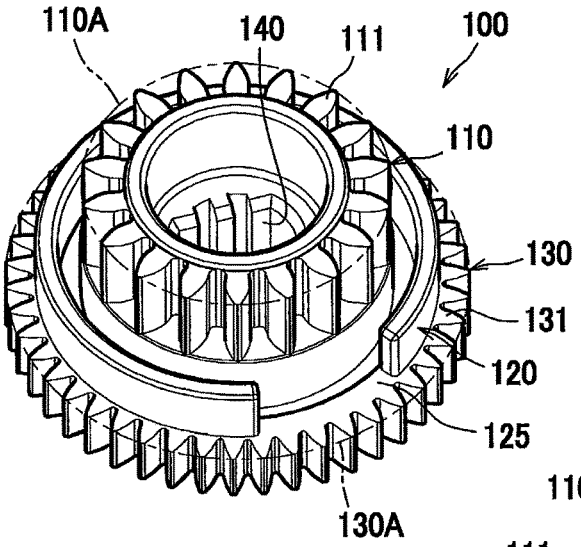
FIG. 8(*a*) is an enlarged perspective view of a second agitator gear in the developing cartridge according to the embodiment.
Figure 8B:
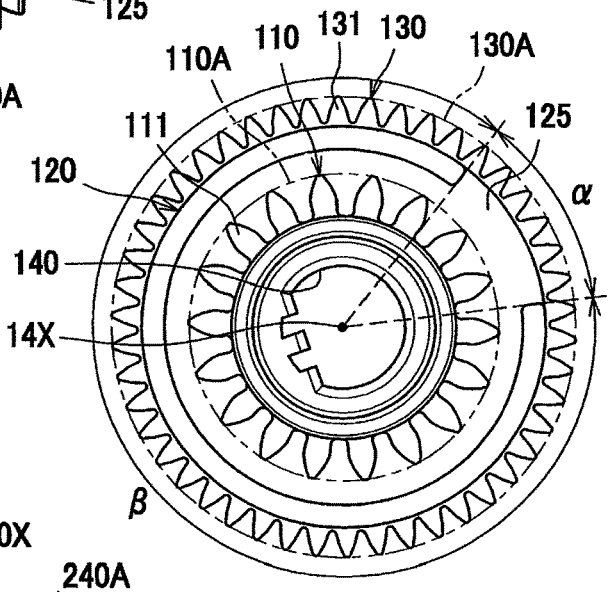
Figure 8C:
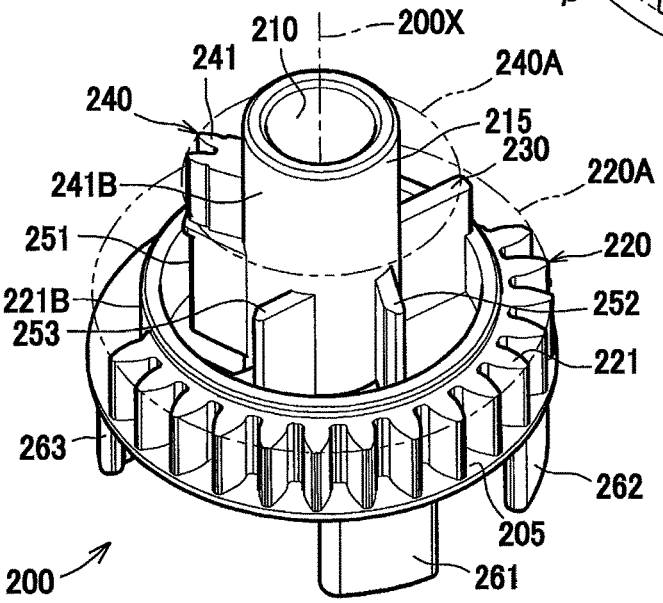

As illustrated in FIGS. 8(*a*) and 8(*b*), the second agitator gear 100 also includes a first gear part 110, a first rib 120, and a third gear part 130.

The first gear part 110 includes a plurality of gear teeth 111. In this example, the first gear part 110 includes gear teeth 111 arranged along the entire circumferential surface of the second agitator gear 100.

The first rib 120 extends along an addendum circle 110A of the first gear part 110. Specifically, the first rib 120 extends along a portion of the addendum circle 110A. In other words, the first rib 120 extends along a portion of a circumferential surface of the second agitator gear 100. That is, the first rib 120 has a gap 125 so that the first rib 120 does not extend along an entire circumferential surface of the second agitator gear 100. The gap 125 is configured to receive a second rib 230 described later therein. The gap 125 can be defined by a center angle $\alpha$ centered on the first axis 14X. The center angle $\alpha$ is within the range of from 15° to 75°, and preferably within the range of from 30° to 60°, and more preferably within the range of from 40° to 50°. The first rib 120 can be defined by a center angle $\beta$ centered on the first axis 14X. The center angle $\beta$ is within the range of from 285° to 345°, and preferably within the range of from 300° to 330°, and more preferably within the range of from 310° to 320°.

The first rib 120 is positioned farther from the first axis 14X than the first gear part 110 is from the first axis 14X in a radial direction of the second agitator gear 100. The first rib 120 can rotate together with the first gear part 110 about the first axis 14X. The first rib 120 is positioned at a position different from a position of the first gear part 110 in the axial direction. Specifically, the first rib 120 is closer to the casing 11 than the first gear part 110 is to the casing 11 in the axial direction (see FIG. 6).

The third gear part 130 includes at least one gear tooth 131 and can rotate about the first axis 14X together with the first gear part 110 and first rib 120. In this example, the third gear part 130 includes gear teeth 131 arranged along the entire circumference of the second agitator gear 100. The third gear part 130 is at a position different from the position of the first gear part (110) and the first rib (120) in the axial direction. Specifically, the third gear part 130 is closer to the casing 11 than the first gear part 110 and first rib 120 are to the casing 11 in the axial direction (see FIG. 6). The third gear part 130 has an addendum circle 130A greater than the addendum circle 110A of the first gear part 110.

As illustrated in FIG. 6, the detection gear 200 is positioned at the second end of the casing 11 in the first direction. That is, the detection gear 200 is positioned at the outer surface 11E. The detection gear 200 is rotatable about a second axis 200X extending in the axial direction. The detection gear 200 can engage with the second agitator gear 100 and can rotate together with the same. The detection gear 200 includes a hollow cylindrical part 215. The cylindrical part 215 has a hole 210. The shaft 31B of the second gear cover 31 is inserted into the hole 210, enabling the detection gear 200 to rotate about the shaft 31B. The cover 11B of the casing 11 includes a side wall 11D at the second end of the cover 11B in the first direction. The side wall 11D has a support hole 11F. The distal end portion of the shaft 31B is inserted into the support hole 11F and supported by the side wall 11D.

The detection gear 200 includes a disc part 205 extending in a plane that crosses the axial direction, and preferably extending in a plane orthogonal to the axial direction. FIG. 8(*c*) shows a structure on a first side of the disc part 205 in the first direction, i.e., the first side facing the casing 11. As illustrated in FIG. 8(*c*), the detection gear 200 includes a second gear part 220, a second rib 230, a fourth gear part 240, a first spring engaging part 251, a second spring engaging part 252, and a third spring engaging part 253.

The second gear part 220 includes a plurality of gear teeth 221. The second gear part 220 is provided at a portion of the circumference of the detection gear 200. The detection gear 200 also includes a toothless section 221B at the same position in the axial direction as the second gear part 220. The toothless section 221 B is provided at the circumference of the detection gear 200 at which the second gear part 220 is not provided. Hence, the toothless section 221B is provided at the circumference of the detection gear 200 at which the gear teeth 221 is not provided.

The second rib 230 protrudes radially outward from the cylindrical part 215. The second rib 230 also protrudes in the axial direction from the disc part 205. The second rib 230 has a plate shape. The second rib 230 is positioned at a position different from the second gear part 220 in the axial direction. Specifically, the second rib 230 is closer to the casing 11 than the second gear part 220 is to the casing 11 in the axial direction. The second rib 230 is also closer to the second axis 200X than the second gear part 220 is to the second axis 200X in a radial direction of the detection gear 200.

The fourth gear part 240 includes at least one gear tooth 241. The fourth gear part 240 can rotate about the second axis 200X together with the second gear part 220 and second rib 230. The fourth gear part 240 is separated from the second gear part 220 in the rotating direction of the detection gear 200. The fourth gear part 240 has an addendum circle 240A smaller than an addendum circle 220A of the second gear part 220. Since the addendum circle 130A of the third gear part 130 is larger than the addendum circle 110A of the first gear part 110 and the addendum circle 240A of the fourth gear part 240 is smaller than the addendum circle 220A of the second gear part 220, the detection gear 200 rotates at a slower speed in a case where the second gear part 220 engages with the first gear part 110, and rotates at a faster speed in a case where the fourth gear part 240 engages with the third gear part 130.

The fourth gear part 240 is provided at a portion of the circumference of the detection gear 200. The detection gear 200 also includes a toothless section 241B. The toothless section 241B is positioned at the same position in the axial direction as the fourth gear part 240, and the toothless section 241 B is provided at the circumference of the detection gear 200 at which the fourth gear part 240 is not provided. The toothless section 241B is provided at a remaining portion of the circumference of the detection gear 200 at which no gear teeth 241 is provided. The second gear part 220 is positioned at a position different from a position of the fourth gear part 240 in the rotating direction of the detection gear 200. Specifically, the fourth gear part 240 is positioned apart from and downstream of the second gear part 220 in the rotating direction of the detection gear 200.

The fourth gear part 240 is closer to the casing 11 than the second gear part 220 is to the casing 11 in the axial direction. In the rotating direction of the detection gear 200, the second gear part 220 has a greater length than the fourth gear part 240.

Each of the first spring engaging part 251, the second spring engaging part 252, and the third spring engaging part 253 protrude outward from the cylindrical part 215 in a radial direction of the detection gear 200. Each of the spring engaging parts 251, 252, and 253 also protrude from the disc part 205 in the axial direction. Each of the spring engaging parts 251, 252, and 253 has a plate shape. Each of the spring engaging parts 251, 252, and 253 can receive a force from the torsion spring 37 in a case where the spring engaging parts 251, 252, and 253 engages with the torsion spring 37. The spring engaging parts 251, 252, and 253 are arranged at intervals in the rotating direction of the detection gear 200.

FIG. 6 shows a structure of the second side of the disc part 205 in the first direction, i.e., the second side facing away from the casing 11. As illustrated in FIG. 6, the detection gear 200 includes a first protrusion 261, a second protrusion 262, a third protrusion 263, and a fourth protrusion 270.

The first protrusion 261 protrudes in the axial direction. The first protrusion 261 also protrudes in a radial direction of the detection gear 200. More specifically, the first protrusion 261 protrudes in the axial direction from the disc part 205. Further, the first protrusion 261 protrudes outward from the cylindrical part 215 in the radial direction of the detection gear 200. The first protrusion 261 can move together with the detection gear 200, and preferably can rotate together with the detection gear 200. Hence, the detection gear 200 includes the first protrusion 261. In the preferred embodiment, the first protrusion 261 is integrally formed with the detection gear 200, but the first protrusion 261 and detection gear 200 may be separate components instead.

The second protrusion 262 protrudes in the axial direction. The second protrusion 262 also protrudes in the radial direction of the detection gear 200. More specifically, the second protrusion 262 protrudes in the axial direction from the disc part 205. Further, the second protrusion 262 protrudes outward from the cylindrical part 215 in the radial direction of the detection gear 200. The second protrusion 262 is separated from the first protrusion 261 in the rotating direction of the detection gear 200. The second protrusion 262 can move together with the detection gear 200, and preferably can rotate together with the detection gear 200. Hence, the detection gear 200 includes the second protrusion 262. In the preferred embodiment, the second protrusion 262 is integrally formed with the detection gear 200, but the second protrusion 262 and detection gear 200 may be separate components.

The third protrusion 263 protrudes in the axial direction. The third protrusion 263 also protrudes in the radial direction of the detection gear 200. More specifically, the third protrusion 263 protrudes in the axial direction from the disc part 205. Further, the third protrusion 263 protrudes outward from the cylindrical part 215 in the radial direction of the detection gear 200. The third protrusion 263 is separated from both the first protrusion 261 and second protrusion 262 in the rotating direction of the detection gear 200. The third protrusion 263 can move together with the detection gear 200, and preferably can rotate together with the detection gear 200. Hence, the detection gear 200 includes the third protrusion 263. In the preferred embodiment, the third protrusion 263 is integrally formed with the detection gear 200, but the third protrusion 263 and detection gear 200 may be separate components.

The first protrusion 261, the second protrusion 262, and the third protrusion 263 are arranged in such positions to contact the lever 7A in the radial direction of the detection gear 200. The first protrusion 261, third protrusion 263 and the second protrusion 262 are arranged in this order given in the clockwise direction in FIG. 6. The distal end of each of the first protrusion 261, second protrusion 262, and third protrusion 263 has a prescribed length in the rotating direction. The distal end of the third protrusion 263 in the rotating direction is longer than the distal ends of the first protrusion 261 and second protrusion 262 in the rotating direction.

The fourth protrusion 270 protrudes in the axial direction from the disc part 205 and the cylindrical part 215. The fourth protrusion 270 also protrudes outward from the cylindrical part 215 in the radial direction of the detection gear 200. The fourth protrusion 270 can rotate together with the detection gear 200. Hence, the detection gear 200 includes the fourth protrusion 270. In the preferred embodiment, the fourth protrusion 270 is integrally formed with the detection gear 200.

The fourth protrusion 270 is engageable with the anchoring protrusion 31C (FIG. 7) of the second gear cover 31 to fix a posture or angular rotational position of the detection gear 200 after the detection gear 200 is operated.

The second gear part 220 of the detection gear 200 is positioned between the second rib 230 and second protrusion 262 in the axial direction. The second gear part 220 is also positioned between the second rib 230 and first protrusion 261 in the axial direction.

The torsion spring 37 includes a coil part 37A, a first arm 37B, and a second arm 37C. The first arm 37B and second arm 37C both extend from the coil part 37A. The second arm 37C contacts and catches a portion of the second gear cover 31.

Figure 9A:
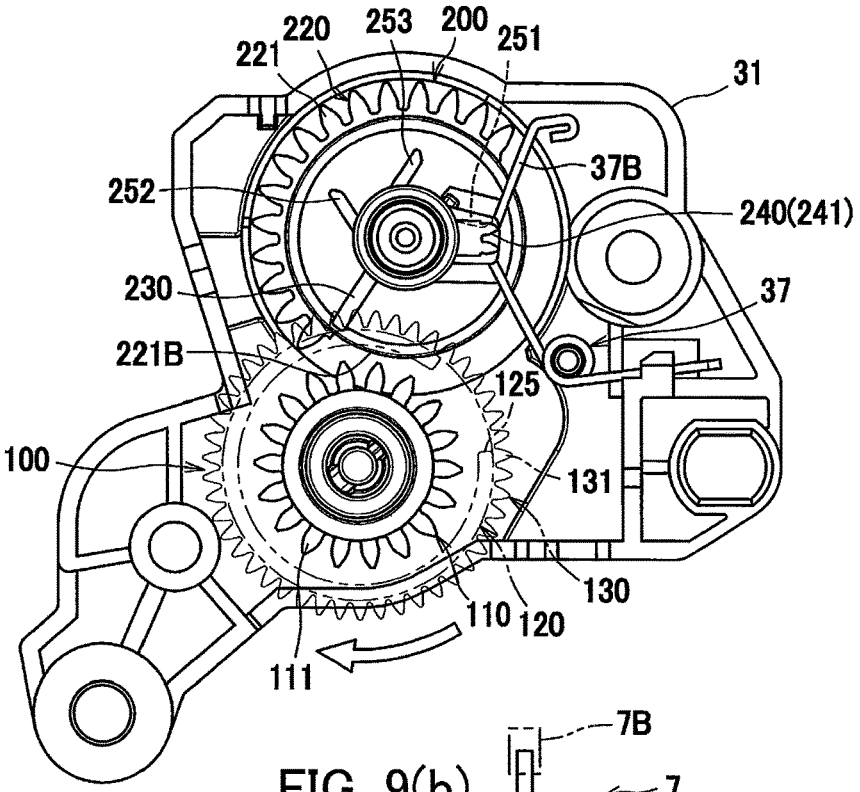
FIG. 9(*a*) is a view illustrating an initial position of the second agitator gear and the detection gear, when viewed from an inside.
Figure 9B:
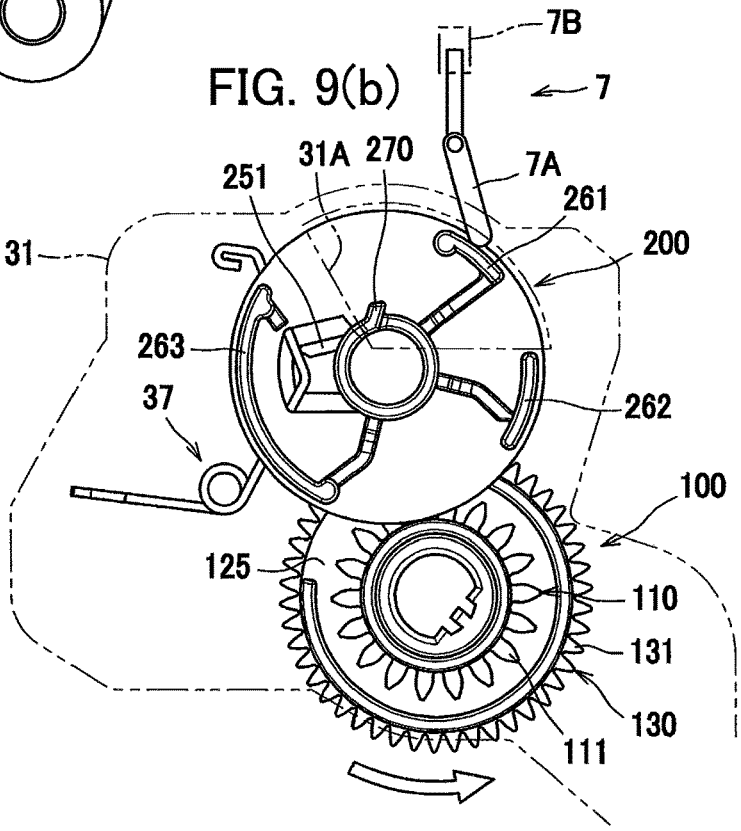

In a case where the second rib 230 is in contact with the first rib 120, the torsion spring 37 urges the detection gear 200 to rotate such that the second rib 230 is pressed against the first rib 120. More specifically, in a case where the second rib 230 is in contact with the outer circumferential surface of the first rib 120, as illustrated in FIG. 9(*a*), the first arm 37B contacts the first spring engaging part 251 and urges the detection gear 200 to rotate in counterclockwise direction in FIG. 9(*a*). In a case where the second rib 230 is not in contact with the first rib 120, the urging force of the torsion spring 37 rotates the detection gear 200 until the second gear part 220 becomes engaged with the first gear part 110.

In a case where the developing cartridge 10 is unused, the position of the detection gear 200 relative to the second gear cover 31 is that illustrated in FIGS. 9(*a*) and 9(*b*). Hereinafter, the positions of the second agitator gear 100 and detection gear 200 in FIGS. 9(*a*) and (*b*) will be referred to as an initial position. Incidentally, the detection gear 200 is in the initial position in a case where the developing cartridge 10 is unused. In a case where the detection gear 200 is in the initial position, as illustrated in FIG. 9(*b*), the distal end of the first protrusion 261 is exposed through the opening 31A. In this state, the distal end of the first protrusion 261 contacts the lever 7A, so that the lever 7A is positioned between the light-emitting element and light-receiving element of the optical sensor 7B. Consequently, the lever 7A blocks light emitted from the light-emitting element.

The second agitator gear 100 can rotate about the first axis 14X from a first position to a second position and from the second position to a third position. The first position is the initial position illustrated in FIGS. 9(*a*) and 9(*b*). The second position is the position illustrated in FIG. 10(*b*) at which the first gear part 110 initially engages with the second gear part 220. The third position is the final position illustrated in FIGS. 13(*a*) and 13(*b*), for example. In a case where the second agitator gear 100 rotates from the first position toward the second position, the second rib 230 is in contact with the first rib 120 and, hence, the detection gear 200 does not rotate together with the second agitator gear 100. In a case where the second agitator gear 100 rotates from the second position toward the third position, the second rib 230 is not in contact with the first rib 120 and, hence, the detection gear 200 rotates together with the second agitator gear 100.

The detection gear 200 can rotate from a non-engaged position, in which none of the gear teeth 111 of the first gear part 110 engages with the gear teeth 221 on the second gear part 220, to a first engaged position, in which at least one of the gear teeth 111 engages with at least one of the gear teeth 221. The non-engaged position is the initial position in FIGS. 9(*a*) and 9(*b*), for example. The first engaged position is the position illustrated in FIG. 10(*b*), for example. The detection gear 200 is in the non-engaged position in a case where the second rib 230 is in contact with the first rib 120, and is in the first engaged position in a case where the second rib 230 is not in contact with the first rib 120.

Further, the detection gear 200 can also rotate from the first engaged position to a second engaged position. In the first engaged position, at least one of the gear teeth 221 of the second gear part 220 engages with at least one of the gear teeth 111 of the first gear part 110, while the gear tooth 241 of the fourth gear part 240 is not engaged with any of the gear teeth 131 of the third gear part 130. In the second engaged position, none of the gear teeth 221 on the second gear part 220 engages with the gear teeth 111 of the first gear part 110, and the gear tooth 241 of the fourth gear part 240 engages with at least one of the gear teeth 131 of the third gear part 130. The second engaged position is the position illustrated in FIG. 12(*a*), for example.

Figure 11A:
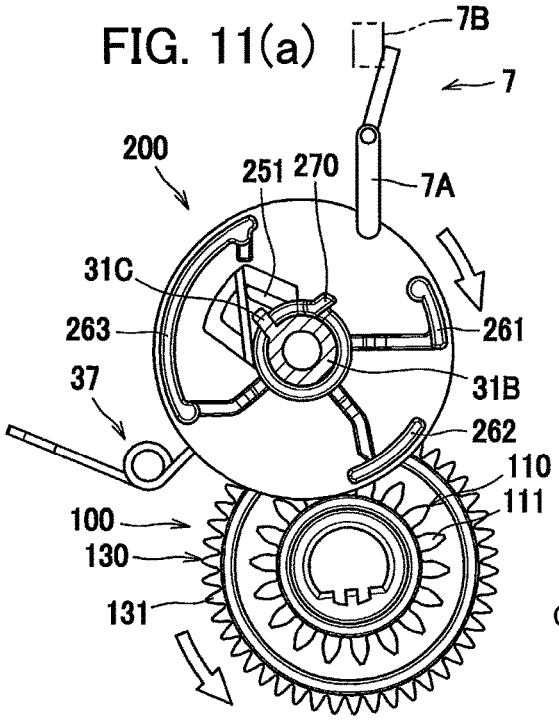
FIGS. 11(*a*) through 11(*c*) illustrate gradual change in posture of a lever in accordance with gradual rotation of the detection gear from its initial position in the developing cartridge according to the embodiment, and rotation angle of the detection gear is increased from a state illustrated in FIG. 11(*a*) to FIG. 11(*c*)
Figure 11B:
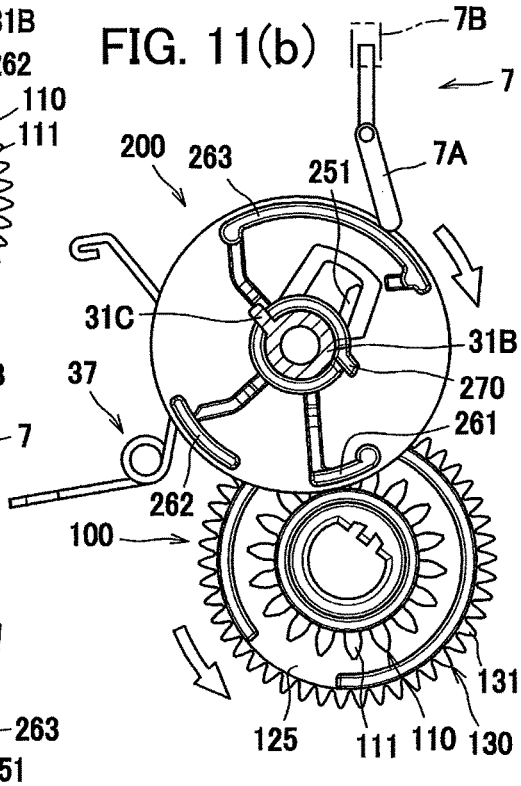
Figure 11C:
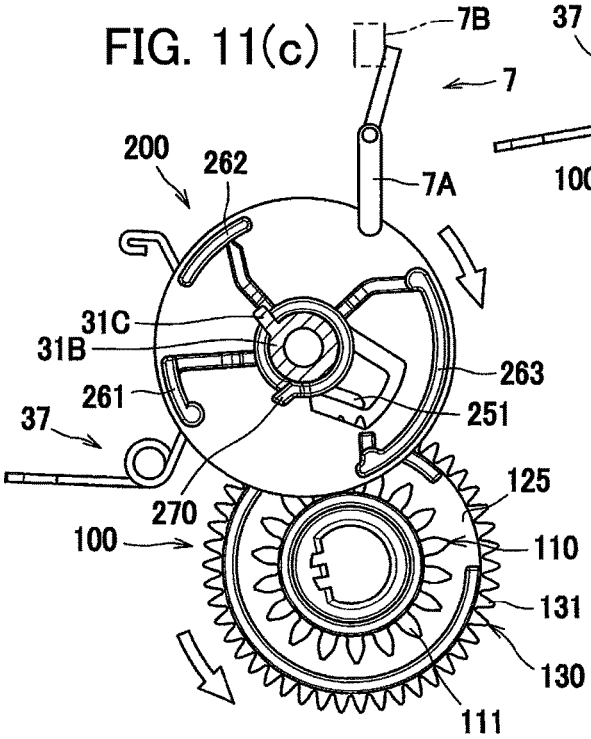
Figure 13A:
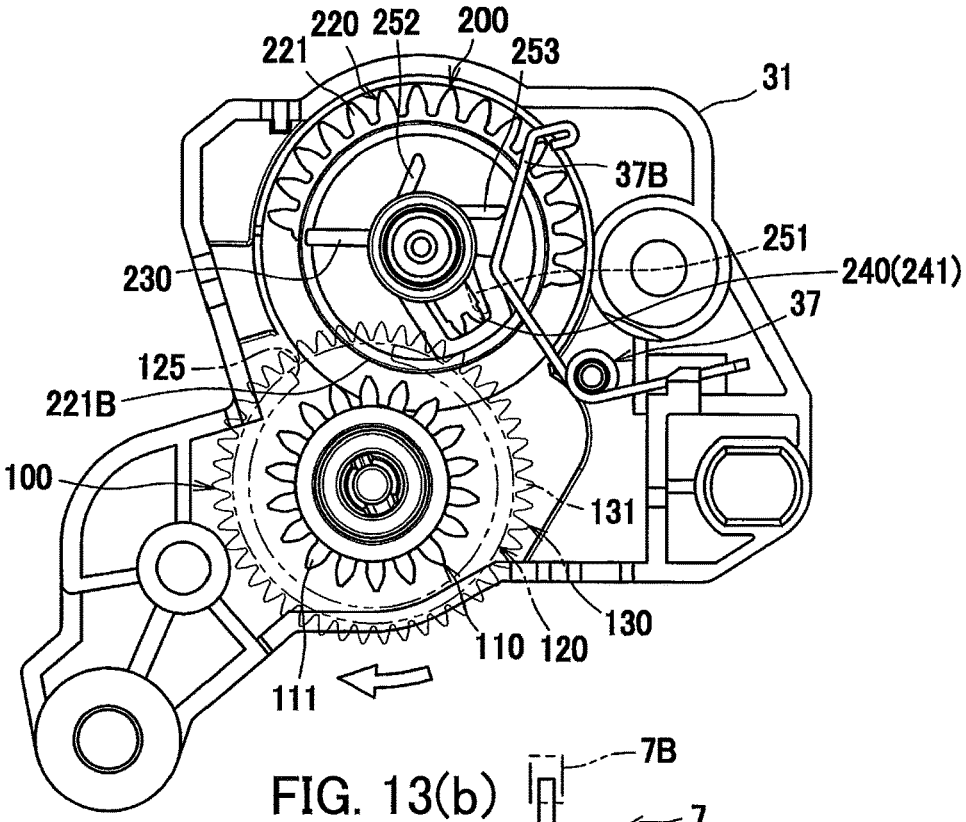
FIG. 13(*a*) is a view illustrating the second agitator gear and the detection gear, when viewed from the inside, and particularly illustrating terminal position of the detection gear and the second agitator gear in the developing cartridge according to the embodiment.
Figure 13B:
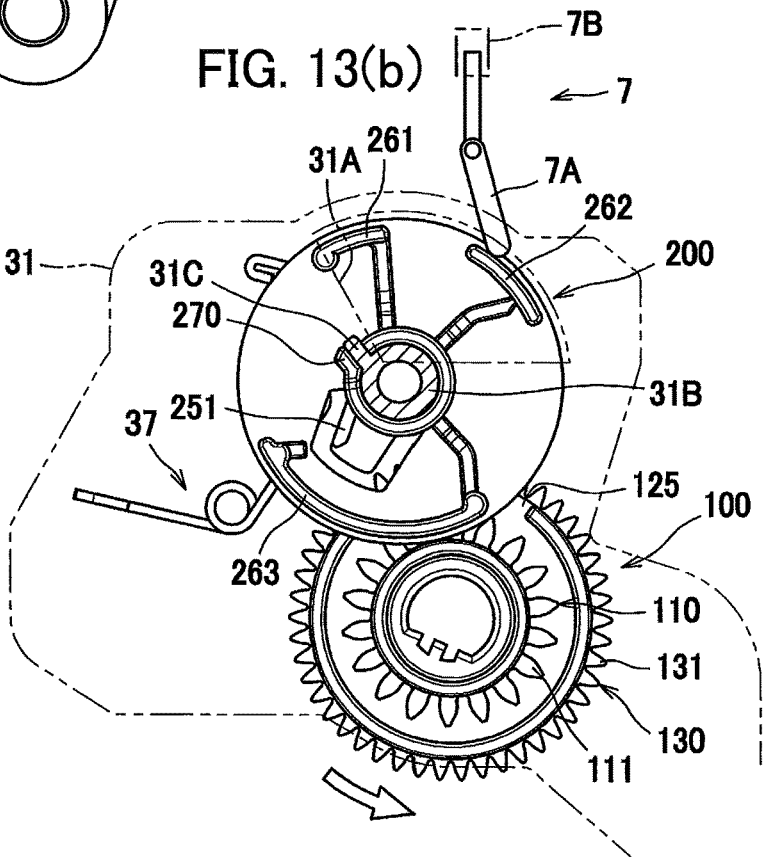

The detection gear 200 rotates from the initial position to the final position illustrated in FIG. 13(*a*) through the positions illustrated in FIGS. 11(*a*), 11(*b*), and 11(*c*), and comes to a halt in the final position. In other words, the detection gear 200 can rotate from the initial position to the final position. In a case where the detection gear 200 is in the final position, the torsion spring 37 contacts the third spring engaging part 253 as illustrated in FIG. 13(*a*), and urges the detection gear 200 to rotate in the counterclockwise direction in FIG. 13(*a*). As illustrated in FIG. 13(*b*), the fourth protrusion 270 is in contact with the anchoring protrusion 31C in the final position and is pressed against the anchoring protrusion 31C by the urging force of the torsion spring 37.

In a case where the detection gear 200 is in the position illustrated in FIG. 11(*a*), the distal end of the third protrusion 263 does not contact the lever 7A. However, in a case where the detection gear 200 is in the position illustrated in FIG. 11(*b*), the distal end of the third protrusion 263 contacts the lever 7A and holds the lever 7A in a position between the light-emitting element and light-receiving element of the optical sensor 7B. Accordingly, the lever 7A blocks light emitted from the light-emitting element. In a case where the detection gear 200 is in the position illustrated in FIG. 11(*c*), the distal end of the third protrusion 263 does not contacts the lever 7A.

In a case where the detection gear 200 is in the final position, the second protrusion 262 is at approximately the same position as the first protrusion 261 in a case where the detection gear 200 is in the initial position. In a case where the detection gear 200 is in the final position, the distal end of the second protrusion 262 contacts the lever 7A and holds the lever 7A in a position between the light-emitting element and light-receiving element. Accordingly, the lever 7A blocks light emitted from the light-emitting element.

Further, in a case where the detection gear 200 is in the state illustrated in FIG. 11(*a*) or 11(*c*), none of the distal ends of the first protrusion 261, the second protrusion 262, and the third protrusion 263 contacts the lever 7A and, hence, the lever 7A is not positioned between the light-emitting element and light-receiving element. Consequently, the lever 7A does not block light emitted from the light-emitting element, and the light-receiving element can receive the emitted light.

As described above, the laser printer 1 can identify specifications of the developing cartridge 10 based on detection signals obtained from the optical sensor 7B in a case where the light-receiving element receives light and in a case where the light-receiving element does not receive light. Further, in the preferred embodiment, the distal end of the first protrusion 261 contacts the lever 7A in a case where the detection gear 200 is in the initial position, and the distal end of the second protrusion 262 contacts the lever 7A in a case where the detection gear 200 is in the final position. Accordingly, the laser printer 1 can determine whether the developing cartridge 10 is attached to the laser printer 1 through use of the first protrusion 261 and second protrusion 262.

Turning back to FIG. 6, the second bearing 34 includes a first support part 34A, and a second support part 34B. The first support part 34A rotatably supports the developing-roller shaft 12A. The second support part 34B rotatably supports the supply-roller shaft 13A. The second bearing 34 is fixed to the outer surface 11E of the second end of the container 11A of the casing 11 while supporting the developing-roller shaft 12A and supply-roller shaft 13A.

The developing electrode 35 is positioned at the second end of the casing 11 in the first direction. In other words, the developing electrode 35 is positioned at the outer surface 11E. The developing electrode 35 is configured to supply power to the developing-roller shaft 12A. The developing electrode 35 is formed of an electrically conductive resin, for example. The developing electrode 35 includes a first electrical contact 35A, a second electrical contact 35B, and a coupling part 35C. The first electrical contact 35A contacts the developing-roller shaft 12A. The coupling part 35C connects the first electrical contact 35A to the second electrical contact 35B and is electrically connected to both the first electrical contact 35A and second electrical contact 35B.

The first electrical contact 35A includes a contact hole 35E. The developing-roller shaft 12A is inserted into the contact hole 35E. The second hole 35E is preferably a circular-shaped hole. In a case where the developing-roller shaft 12A is inserted into the contact hole 35E, the first electrical contact 35A contacts a portion of the developing-roller shaft 12A. Specifically, the first electrical contact 35A contacts the circumferential surface of the developing-roller shaft 12A while the developing-roller shaft 12A is inserted in the contact hole 35E. The second electrical contact 35B of the developing electrode 35 includes a developing contact surface 35D extending in the second and third directions.

The supply electrode 36 is positioned at the second end of the casing 11 in the first direction. That is, the supply electrode 36 is positioned at the outer surface 11E. The supply electrode 36 is configured to supply power to the supply-roller shaft 13A. The supply electrode 36 is formed of an electrically conductive resin, for example. The supply electrode 36 includes a first electrical contact 36A, a second electrical contact 36B, and a coupling part 36C. The first electrical contact 36A contacts the supply-roller shaft 13A. The coupling part 36C connects the first electrical contact 36A and second electrical contact 36B and is electrically connected to both the first electrical contact 36A and second electrical contact 36B.

The first electrical contact 36A has a contact hole 36E. The supply-roller shaft 13A is inserted into the contact hole 36E. The contact hole 36E is preferably a circular-shaped hole. In a case where the supply-roller shaft 13A is inserted into the contact hole 36E, the first electrical contact 36A contacts a portion of the supply-roller shaft 13A. Specifically, the first electrical contact 36A contacts the circumferential surface of the supply-roller shaft 13A while the supply-roller shaft 13A is inserted into the contact hole 36E. The second electrical contact 36B of the supply electrode 36 includes a supply contact surface 36D extending in the second and third directions.

Together with the second bearing 34, the developing electrode 35 and supply electrode 36 are fixed to the outer surface 11E positioned at the second end of the casing 11 with screws 38.

Operation and effect in the developing cartridge 10 thus constructed will next be described. As illustrated in FIG. 1, the developing cartridge 10 is attached to the laser printer 1 in such a manner that the developing roller 12 is a leading end in the inserting direction i.e., in the third direction.

In a case where the developing cartridge 10 is unused, as shown in FIG. 1, i.e., in a case where the detection gear 200 is in the initial position, the distal end of the first protrusion 261 is exposed through the opening 31A. Accordingly, the distal end of the first protrusion 261 contacts and pivots the lever 7A. In a case where the optical sensor 7B detects this displacement of the lever 7A, the control unit CU can determine that the developing cartridge 10 is attached to the laser printer 1, as described earlier. Here, the second protrusion 262 is not exposed through the opening 31A in a case where the detection gear 200 is in the initial position and, hence, does not contact the lever 7A.

In a case where the detection gear 200 is in the initial position, as illustrated in FIG. 9(*a*), the torsion spring 37 urges the detection gear 200 in the rotating direction (i.e., counterclockwise in FIG. 9(*a*)). However, the detection gear 200 cannot rotate because the distal end of the second rib 230 contacts the first rib 120 of the second agitator gear 100, halting such rotation. Further, the first gear part 110 of the second agitator gear 100 faces the toothless section 221B of the detection gear 200. The third gear part 130 of the second agitator gear 100 also faces the toothless section 241B of the detection gear 200.

In response to a command from the control unit CU, the laser printer 1 begins driving the coupling 22 through the drive member (not shown). As shown in FIG. 4, rotation of the coupling 22 is transmitted via the idle gear 26 to the first agitator gear 25 and rotates the first agitator gear 25. In a case where the first agitator gear 25 rotates, the second agitator gear 32 provided at the second end of the developing cartridge 10 is rotated via the agitator 14.

In a case where the second agitator gear 100 rotates in the direction indicated by the arrow in FIGS. 9(*a*) and 9(*b*), a rotational force is not transmitted from the second agitator gear 100 to the detection gear 200 because the first gear part 110 of the second agitator gear 100 faces the toothless section 221B of the detection gear 200 and the third gear part 130 faces the toothless section 241B. In other words, the detection gear 200 is in the non-engaged position. In a case where the second agitator gear 100 rotates, the distal end of the second rib 230 slides over the outer circumferential surface of the first rib 120.

Figure 10A:
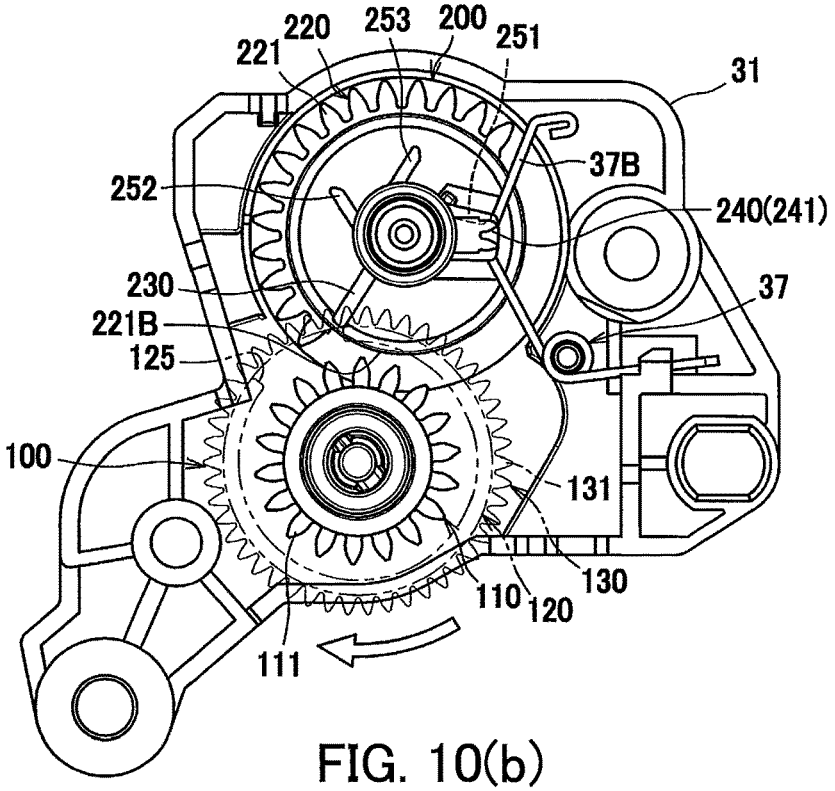
FIG. 10(*a*) is a view illustrating the second agitator gear and the detection gear, when viewed from the inside, and particularly illustrating a state where a second rib is entering a gap of a first rib in the developing cartridge according to the embodiment.
Figure 10B:
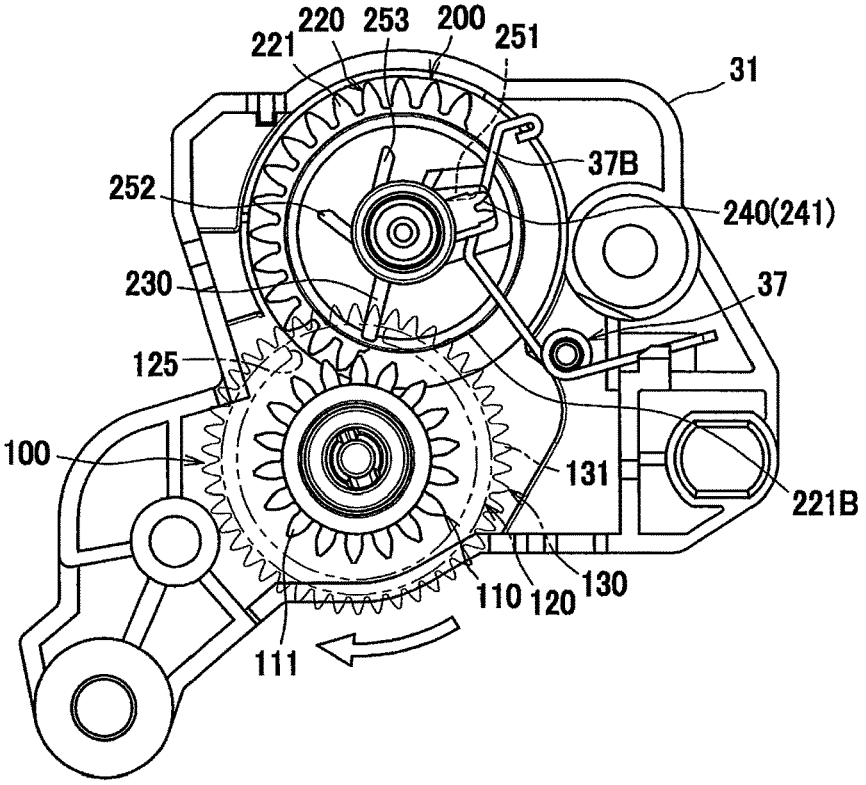

As the second agitator gear 100 rotates, the gap 125 of the first rib 120 approaches the distal end of the second rib 230, as illustrated in FIG. 10(*a*). In a case where the gap 125 moves to face the second rib 230 as illustrated in FIG. 10(*b*), the distal end of the second rib 230 enters the gap 125 as the detection gear 200 is rotated by the urging force of the torsion spring 37. Consequently, the gear teeth 221 on the second gear part 220 engage with the gear teeth 111 of the first gear part 110. Hence, the second agitator gear 100 shifts to the second position, and the detection gear 200 shifts to the first engaged position.

In a case where the first gear part 110 becomes engaged with the second gear part 220, the rotational force of the second agitator gear 100 is transmitted to the detection gear 200, causing the detection gear 200 to rotate together with the second agitator gear 100. As a result, the detection gear 200 rotates at a low speed through the positions illustrated in FIGS. 11(*a*) through 11(*c*).

As the detection gear 200 rotates, the lever 7A moves to a position between the first protrusion 261 and third protrusion 263, as illustrated in FIG. 11(*a*). Thus, none of the first protrusion 261, the second protrusion 262, and the third protrusion 263 is in contact with the lever 7A. Consequently, the lever 7A is no longer positioned between the light-emitting element and light-receiving element of the optical sensor 7B, and the signal that the control unit CU receives from the optical sensor 7B changes.

As the detection gear 200 continues to rotate, the third protrusion 263 becomes exposed through the opening 31A and contacts the lever 7A, as illustrated in FIG. 11(*b*). This contact moves the lever 7A back to a position between the light-emitting element and light-receiving element of the optical sensor 7B. Accordingly, the signal that the control unit CU receives from the optical sensor 7B changes again.

As the detection gear 200 continues to rotate, the lever 7A becomes positioned between the third protrusion 263 and second protrusion 262, as illustrated in FIG. 11(*c*). At this time, none of the first protrusion 261, the second protrusion 262, and the third protrusion 263 contacts the lever 7A. Accordingly, the lever 7A is not positioned between the light-emitting element and light-receiving element of the optical sensor 7B, and the signal that the control unit CU receives from the optical sensor 7B changes again.

Figure 12A:
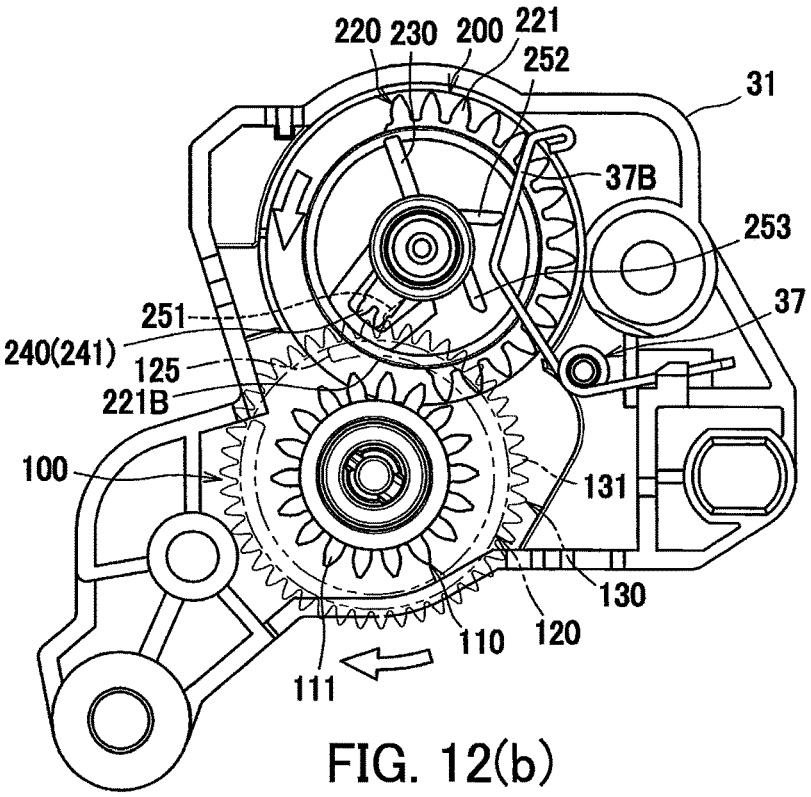
FIG. 12(*a*) is a view illustrating the second agitator gear and the detection gear, when viewed from the inside, and particularly illustrating a state where meshing engagement between a third gear part and a fourth gear part is started in the developing cartridge according to the embodiment.
Figure 12B:
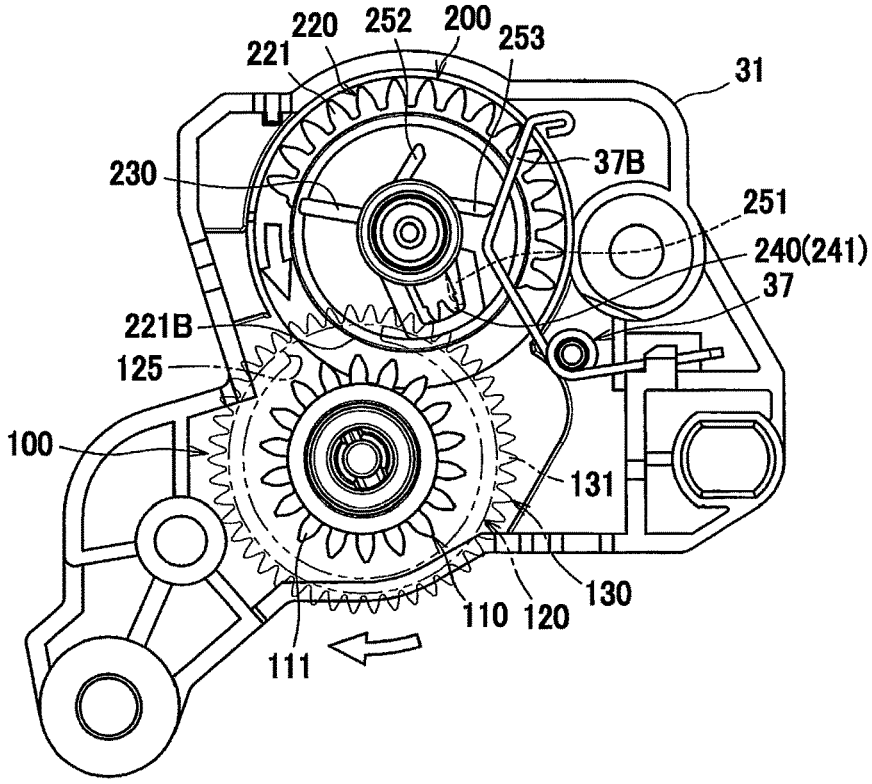

As the detection gear 200 continues to rotate, the gear teeth 221 on the second gear part 220 of the detection gear 200 separate from the gear teeth 111 of the first gear part 110 of the second agitator gear 100, disengaging the second gear part 220 from the first gear part 110, as illustrated in FIG. 12(*a*). As a result, the rotational force of the second agitator gear 100 is not transmitted to the detection gear 200. However, the first arm 37B of the torsion spring 37 contacts the second spring engaging part 252 of the detection gear 200 at this time and applies a rotational force to the detection gear 200. Hence, the detection gear 200 rotates counterclockwise in FIG. 12(*a*) even directly after the second gear part 220 becomes disengaged from the first gear part 110. At this time, the gear tooth 241 of the fourth gear part 240 of the detection gear 200 engages with the gear teeth 131 of the third gear part 130 of the second agitator gear 100, as illustrated in FIG. 12(*a*). Accordingly, the rotational force of the second agitator gear 100 is transmitted to the detection gear 200 via the third gear part 130 and fourth gear part 240, causing the detection gear 200 to rotate at a high speed.

While the second agitator gear 100 continues to rotate clockwise from the state in FIG. 12(*a*), the detection gear 200 rotates counterclockwise at a high speed. Thereafter, the gear tooth 241 of the fourth gear part 240 separates from the gear teeth 131 of the third gear part 130 so that the fourth gear part 240 disengages from the third gear part 130, as illustrated in FIG. 12(*b*). As a result, the rotational force of the second agitator gear 100 is not transmitted to the detection gear 200. However, the first arm 37B of the torsion spring 37 contacts the third spring engaging part 253 of the detection gear 200 at this time and applies a rotational force to the detection gear 200. Accordingly, the detection gear 200 continues to rotate counterclockwise in FIG. 12(*b*) until arriving at the final position illustrated in FIGS. 13(*a*) and 13(*b*).

In the final position illustrated in FIGS. 13(*a*) and 13(*b*), the second protrusion 262 is exposed through the opening 31A and contacts the lever 7A. This contact moves the lever 7A to a position between the light-emitting element and light-receiving element of the optical sensor 7B, again changing the signal that the control unit CU receives from the optical sensor 7B. In a case where the detection gear 200 is in the final position as illustrated in FIG. 13(*a*), the gear teeth 111 of the first gear part 110 faces the toothless section 221B of the detection gear 200 and are not meshed with any of the gear teeth 221. Further, since the posture of the detection gear 200 is maintained by the torsion spring 37, the anchoring protrusion 31C, and the fourth protrusion 270, the detection gear 200 does not rotate thereafter, even when the second agitator gear 100 rotates.

Through the process described above, the output from the optical sensor 7B changes four times after the detection gear 200 begins to rotate. The pattern of these changes in output (e.g., the lengths of the OFF signals or ON signals, the number of changes, or differences in the timing of the changes) can be varied by modifying the number of protrusions that rotate together with the detection gear 200, and the lengths of the protrusions in the rotating direction. By establishing correlations between signal patterns and specifications of developing cartridges 10 in advance, the control unit CU can identify specifications of a developing cartridge 10 from the signal pattern.

In a case where a used developing cartridge 10 is attached to the housing 2 of the laser printer 1, the detection gear 200 is already positioned in the final position. In this case, the distal end of the second protrusion 262 is at the same approximate position as the first protrusion 261 of an unused developing cartridge 10. Hence, in a case where a used developing cartridge 10 is attached to the housing 2, the distal end of the second protrusion 262 contacts the lever 7A, enabling the control unit CU to detect that a developing cartridge 10 is attached to the housing 2. Note that the first protrusion 261 may be partially exposed through the opening 31A in a case where the detection gear 200 is in the final position. However, because the first protrusion 261 is separated from the second protrusion 262, the first protrusion 261 does not contact the lever 7A at this time.

With the developing cartridge 10 according to the embodiment described above, the detection gear 200 does not rotate while the second rib 230 of the detection gear 200 is in contact with the first rib 120 of the second agitator gear 100, even when the second agitator gear 100 rotates. After the second agitator gear 100 rotates from the first position to the second position, the second rib 230 does not contact the first rib 120, and the detection gear 200 begins rotating together with the second agitator gear 100. Hence, the movement of the detection gear 200 can be modified in various ways by adjusting the prescribed time that elapses after initiating rotation of the second agitator gear 100 until initiating rotation of the detection gear 200.

As describe above, the second gear part 220 is positioned at the position different from the position of the fourth gear part 240 in the rotating direction of the detection gear 200, so that the engagement between the first gear part 110 and second gear part 220 is not established at the same time as the engagement between the third gear part 130 and fourth gear part 240. This arrangement ensures a more stable operation.

Various modifications are conceivable.

In the embodiment described above, the first protrusion 261, the second protrusion 262, and the third protrusion 263 can rotate together with the detection gear 200, but the embodiment is not limited to this arrangement. For example, each of the protrusions may not be rotatable together with the detection gear, but may be provided separately from the detection gear, and the detection gear may be provided with a cam. Specifically, the detection gear moves together with the rotation of a coupling. While rotating, the detection gear shifts between a state in which the cam contacts a protrusion and a state in which the cam does not contact a protrusion. In this way, the protrusions are moved through contact with the cam. However, the protrusions may also be moved linearly, as long as the protrusions can move the lever 7A.

In the embodiment described above, the detection gear 200 includes the third protrusion 263 having a distal end with an elongated dimension in the rotating direction, but the present embodiment is not limited to the protrusions provided on the detection gear 200 for moving the lever 7A.

Figure 14A:
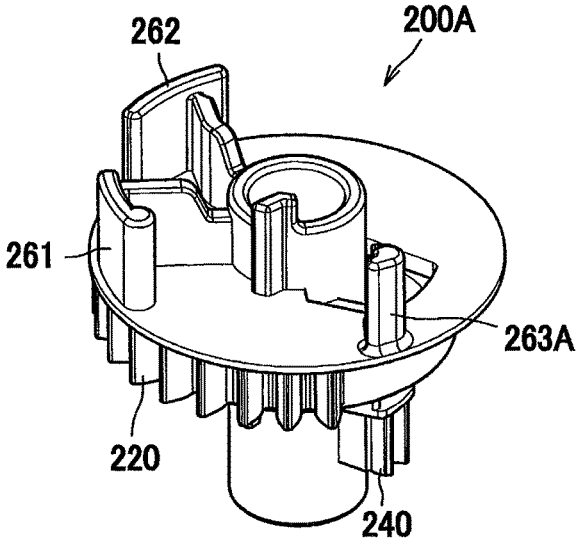
FIG. 14(*a*) is a perspective view of a detection gear according to a first modification.
Figure 14B:
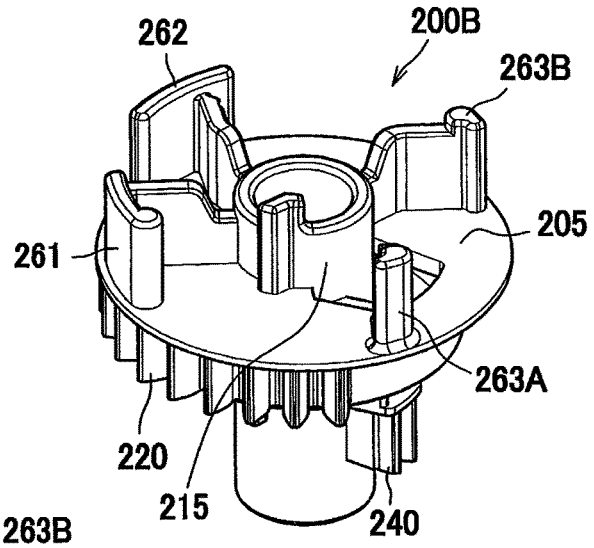
Figure 14C:
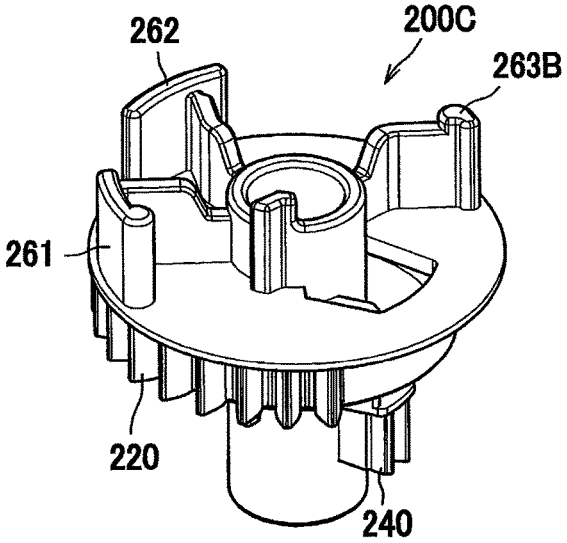

FIG. 14(*a*) illustrates a detection gear 200A according to a first modification. The detection gear 200A includes a third protrusion 263A in place of the third protrusion 263 of the preferred embodiment. The third protrusion 263A is positioned between the first protrusion 261 and second protrusion 262 in the rotating direction. The third protrusion 263A has a short dimension in the rotating direction.

FIG. 14(*b*) illustrates a detection gear 200B according to a second modification. The detection gear 200B includes a pair of third protrusions 263A and 263B positioned between the first protrusion 261 and second protrusion 262 in the rotating direction. The dimension of one of the third protrusions 263A in the rotating direction is shorter than the dimensions of the first protrusion 261 and second protrusion 262 in the rotating direction. The dimension of the remaining one of the third protrusions 263B in the rotating direction is also shorter than the dimensions of the first protrusion 261 and second protrusion 262 in the rotating direction. The third protrusion 263B is positioned upstream of the third protrusion 263A in the rotating direction of the detection gear 200B.

The pair of third protrusions 263A and 263B protrudes in the axial direction. Further, the pair of third protrusions 263A and 263B protrudes in the radial directions of the detection gear 200. More specifically, the pair of third protrusions 263A and 263B protrudes in the axial direction from the disc part 205. Further, the pair of the third protrusions 263A and 263B protrudes outward from the cylindrical part 215 in the radial directions of the detection gear 200. The third protrusions 263A and 263B are separated from the first protrusion 261 and second protrusion 262 in the rotating direction of the detection gear 200. The third protrusions 263A and 263B can move together with the detection gear 200, and preferably can rotate together with the detection gear 200. Hence, the detection gear 200 includes the pair of third protrusions 263A and 263B. In other words, the third protrusions 263A and 263B are integrally formed with the detection gear 200. Note that the third protrusion 263A and detection gear 200 may be configured as separate components. Similarly, the third protrusion 263B and detection gear 200 may be configured as separate components.

FIG. 14(*c*) shows a detection gear 200C according to a third modification. The detection gear 200C includes the third protrusion 263B illustrated in FIG. 14(*b*), but does not include the third protrusion 263A.

In the embodiment described above, the first gear part 110 is provided around the entire circumference of the second agitator gear 100, but the first gear part 110 may be provided at only a portion of the circumference of the second agitator gear 100 instead. Similarly, the third gear part 130 is provided around the entire circumference of the second agitator gear 100, but the third gear part 130 may be provided at only a portion of the circumference of the second agitator gear 100 instead.

The first rib 120 and second rib 230 are not particularly limited to any shape. In the embodiment described above, the first rib 120 has a continuous shape following the circumference of the second agitator gear 100, but the first rib 120 may have a shape extending intermittently along the circumferential direction. That is, the first rib 120 may be configured with an additional gap(s) smaller than the gap 125. This arrangement can achieve the same operations and effects described in the embodiment, provided that the second rib 230 is not inserted into the additional gap(s) shorter than the gap 125 avoiding engagement between the first gear part 110 and second gear part 220. Further, the first rib 120 may protrude radially, rather than in the axial direction.

In the embodiment described above, the developing cartridge 10 is configured as a separate component from the drum cartridge 5, but the two components may be one component.

In the embodiment described above, a monochrome laser printer is used as an example of the image forming apparatus, but the image forming apparatus may be a color image forming apparatus. Further, the exposure unit in the image forming apparatus may employ LED light rather than laser light. Further, the image forming apparatus may be a photocopier or multifunction device, for example.

Any combination of the elements described in the embodiment and the modifications are conceivable as long as the combination does not conflict the heart of the above-described embodiment and modifications.

While the description has been made in detail with reference to the embodiment(s) thereof, it would be apparent to those skilled in the art that many modifications and variations may be made therein without departing from the spirit of the disclosure.

What is claimed is:

1. A developing cartridge comprising:

a casing configured to accommodate therein developing agent;

a first rotary member rotatable about a first axis extending in an axial direction from a first position to a second position and from the second position to a third position, the first rotary member being positioned at an outer surface of the casing, the first rotary member including:

a first gear part including a plurality of gear teeth; and a first rib rotatable together with the first gear part, the first rib being positioned at a position different from a position of the first gear part in the axial direction, the first rib extending along an addendum circle of the first gear part; and a second rotary member rotatable about a second axis extending in the axial direction, the second rotary member including:

a second gear part including a plurality of gear teeth; and a second rib protruding outward in a radial direction of the second rotary member, the second rib being positioned at a position different from the second gear part in the axial direction, wherein, in a case where the first rotary member rotates from the first position to the second position, the second rotary member does not rotate together with the first rotary member in a state where the second rib is in contact with the first rib, and wherein, in a case where the first rotary member rotates from the second position to the third position, the second rotary member rotates together with the first rotary member in a state where the second rib is not in contact with the first rib.

2. The developing cartridge according to claim 1, wherein the second rotary member is rotatable from a non-engaged position in which none of the plurality of gear teeth of the first gear part engages with the plurality of gear teeth of the second gear part to a first engaged position in which at least one gear tooth of the plurality of gear teeth of the first gear part engages with at least one gear tooth of the plurality of gear teeth of the second gear part, wherein the second rotary member is at the non-engaged position in a state where the second rib is in contact with the first rib, and wherein the second rotary member is at the first engaged position in a state where the second rib is not in contact with the first rib.

3. The developing cartridge according to claim 2, further comprising:

a spring configured to urge the second rotary member in a rotating direction so as to press the second rib against the first rib in a state where the second rib is in contact with the first rib, the spring being configured to urge the second rotary member to rotate in the rotating direction so as to engage the second gear part with the first gear part in a case where the second rib is not in contact with the first rib.

4. The developing cartridge according to claim 2, wherein the first rotary member further includes:

a third gear part rotatable together with the first gear part and the first rib, the third gear part including at least one gear tooth, the third gear part being at a position different from the position of the first gear part and the first rib in the axial direction, an addendum circle of the third gear part being greater than the addendum circle of the first gear part, wherein the second rotary member further includes:

a fourth gear part rotatable together with the second gear part and the second rib, the fourth gear part including at least one gear tooth, the fourth gear part being separated from the second gear part in a rotating direction of the second rotary member, an addendum circle of the fourth gear part being smaller than an addendum circle of the second gear part, and wherein the second rotary member is rotatable from the first engaged position in which none of the at least one gear tooth of the fourth gear part engages with the at least one gear tooth of the third gear part to a second engaged position in which none of the plurality of gear teeth of the second gear part engages with the plurality of gear teeth of the first gear part and the at least one gear tooth of the fourth gear part engages with the at least one gear tooth of the third gear part.

5. The developing cartridge according to claim 4, wherein the second gear part is provided along a portion of a circumference of the second rotary member, wherein the fourth gear part is provided along another portion of the circumference of the second rotary member, and wherein a position of the portion of the circumference in the rotating direction of the second rotary member is different from a position of the another portion of the circumference in the rotating direction of the second rotary member.

6. The developing cartridge according to claim 4, wherein a length of the second gear part in the rotating direction is greater than a length of the fourth gear part in the rotating direction.

7. The developing cartridge according to claim 4, wherein the third gear part is positioned closer to the casing than the first gear part is to the casing in the axial direction.

8. The developing cartridge according to claim 4, wherein the fourth gear part is positioned closer to the casing than the second gear part is to the casing in the axial direction.

9. The developing cartridge according to claim 1, wherein the first rib is positioned farther from the first axis than the first gear part is from the first axis in a radial direction of the first rotary member.

10. The developing cartridge according to claim 1, wherein the second rib is positioned closer to the second axis than the second gear part is to the second axis in the radial direction of the second rotary member.

11. The developing cartridge according to claim 1, further comprising:

an agitator configured to agitate the developing agent, the agitator being rotatable about the first axis, wherein the first rotary member is mounted to the agitator, the first rotary member being rotatable together with the agitator.

12. The developing cartridge according to claim 1, further comprising:

a first protrusion protruding in the axial direction, the first protrusion being movable together with the second rotary member.

13. The developing cartridge according to claim 12, further comprising:

a second protrusion protruding in the axial direction, the second protrusion being positioned separate from the first protrusion in the rotating direction of the second rotary member, the second protrusion being movable together with the second rotary member.

14. The developing cartridge according to claim 13, wherein the second protrusion is rotatable together with the second rotary member.

15. The developing cartridge according to claim 13, wherein the second protrusion protrudes from the second rotary member.

16. The developing cartridge according to claim 13, wherein the second gear part is positioned between the second rib and the second protrusion in the axial direction.

17. The developing cartridge according to claim 12, wherein the first protrusion is rotatable together with the second rotary member.

18. The developing cartridge according to claim 12, wherein the first protrusion protrudes from the second rotary member.

19. The developing cartridge according to claim 12, wherein the second gear part is positioned between the second rib and the first protrusion in the axial direction.

20. The developing cartridge according to claim 1, further comprising:

a developing roller rotatable about a third axis extending in the axial direction.

21. The developing cartridge according to claim 1, wherein the first rib extends along a portion of the addendum circle of the first gear part.

22. The developing cartridge according to claim 1, wherein the first rib extends along a portion of a circumference of the first rotary member.

23. The developing cartridge according to claim 1, wherein the first rib has a gap into which the second rib is insertable.

24. The developing cartridge according to claim 23, wherein the gap is defined by a center angle centered on the first axis, the center angle being ranging from 15 degrees to 75 degrees.

25. The developing cartridge according to claim 21, wherein the first rib has an arcuate shape, the first rib being defined by a center angle centered on the first axis, the center angle being ranging from 285 degrees to 345 degrees.

* * * * *